US008222816B2

(12) United States Patent
Lee et al.

(10) Patent No.: US 8,222,816 B2
(45) Date of Patent: Jul. 17, 2012

(54) MULTI PLASMA DISPLAY PANEL

(75) Inventors: Soomyun Lee, Gumi (KR); Yonggi Choi, Gumi (KR); Kyungtae Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 12/638,367

(22) Filed: Dec. 15, 2009

(65) Prior Publication Data

US 2011/0115357 A1 May 19, 2011

(30) Foreign Application Priority Data

Nov. 17, 2009 (KR) ..... 10-2009-0111016
Nov. 17, 2009 (KR) ..... 10-2009-0111017

(51) Int. Cl.
*H01J 17/49* (2012.01)

(52) U.S. Cl. ..... 313/587; 313/586

(58) Field of Classification Search ..... 313/582–587
See application file for complete search history.

(56) References Cited

U.S. PATENT DOCUMENTS

| | | | | |
|---|---|---|---|---|
| 2005/0017637 | A1 | 1/2005 | Kang et al. | 13/582 |
| 2008/0074030 | A1* | 3/2008 | Chu et al. | 313/495 |
| 2008/0122356 | A1* | 5/2008 | Kweon | 313/582 |
| 2008/0122359 | A1 | 5/2008 | Song | 313/584 |
| 2008/0174245 | A1 | 7/2008 | Soh et al. | 313/582 |

FOREIGN PATENT DOCUMENTS

WO WO 2006/049386 A1 5/2006

OTHER PUBLICATIONS

European Search Report dated Sep. 28, 2011 issued in Application No. 09 01 5491.

* cited by examiner

*Primary Examiner* — Bumsuk Won
(74) *Attorney, Agent, or Firm* — Ked & Associates LLP

(57) ABSTRACT

A multi plasma display panel is disclosed. The multi plasma display panel includes a plurality of plasma display panels positioned adjacent to one another, each of the plurality of plasma display panels including, a front substrate on which a first electrode is positioned, a rear substrate on which a second electrode crossing the first electrode is positioned, a barrier rib between the front substrate and the rear substrate, the barrier rib providing a plurality of discharge cells, and an exhaust hole on the rear substrate. The exhaust hole is formed in at least one of the plurality of discharge cells. A size of a discharge cell in which the exhaust hole is formed is greater than a size of at least one discharge cell in which the exhaust hole is not formed.

18 Claims, 32 Drawing Sheets

MULTI PLASMA DISPLAY PANEL

This application claims the benefit of Korean Patent Application Nos. 10-2009-0111017 filed on Nov. 17, 2009 and 10-2009-0111016 filed on Nov. 17, 2009, the entire contents of which is incorporated herein by reference for all purposes as if fully set forth herein.

BACKGROUND OF THE INVENTION

1. Field of the Invention

Embodiments of the invention relate to a multi plasma display panel.

2. Discussion of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a multi plasma display panel comprising a plurality of plasma display panels positioned adjacent to one another, each of the plurality of plasma display panels including, a front substrate on which a first electrode is positioned, a rear substrate on which a second electrode crossing the first electrode is positioned, a barrier rib between the front substrate and the rear substrate, the barrier rib providing a plurality of discharge cells, and an exhaust hole on the rear substrate, the exhaust hole being formed in at least one of the plurality of discharge cells, wherein a size of a discharge cell in which the exhaust hole is formed is greater than a size of at least one discharge cell in which the exhaust hole is not formed.

The exhaust hole may be formed in an outermost discharge cell of the plurality of discharge cells or a discharge cell adjacent to the outermost discharge cell.

A size of at least one of a plurality of discharge cells adjacent to the discharge cell in which the exhaust hole is formed may be smaller than a size of the at least one discharge cell that is not adjacent to the discharge cell in which the exhaust hole is formed.

The barrier rib may include a plurality of longitudinal barrier ribs parallel to the first electrode. A distance between the longitudinal barrier ribs in the discharge cell in which the exhaust hole is formed may be greater than a distance between the longitudinal barrier ribs in the at least one discharge cell in which the exhaust hole is not formed.

The barrier rib may include a plurality of longitudinal barrier ribs parallel to the first electrode. The plurality of discharge cells may include a first discharge cell in which the exhaust hole is formed and a second discharge cell in which the exhaust hole is not formed. A diameter of the exhaust hole in a direction crossing the longitudinal barrier rib may be greater than a width of the second discharge cell in the direction crossing the longitudinal barrier rib.

The second electrode may include a portion formed around the exhaust hole.

The second electrode may include a convex portion in the opposite direction to the exhaust hole.

In another aspect, there is a multi plasma display panel comprising, a plurality of plasma display panels positioned adjacent to one another, each of the plurality of plasma display panels including a plasma display panel comprising a front substrate on which a first electrode is positioned, a rear substrate on which a second electrode crossing the first electrode is positioned, a barrier rib between the front substrate and the rear substrate, the barrier rib providing a plurality of discharge cells, and an exhaust hole on the rear substrate, the exhaust hole being formed in an overlapping portion between at least two adjacent discharge cells.

The exhaust hole may be formed in an overlapping portion between an outermost discharge cell of the plurality of discharge cells and a discharge cell adjacent to the outermost discharge cell.

The plurality of discharge cells may include first and second discharge cells positioned adjacent to each other. The exhaust hole may be formed in an overlapping portion between the first and second discharge cells.

The barrier rib between the first and second discharge cells may be divided with the exhaust hole interposed between the first and second discharge cells.

A diameter of the exhaust hole in a direction parallel to the first electrode may be greater than a width of the first discharge cell and a width of the second discharge cell.

The barrier rib may include a first barrier rib parallel to the first electrode and a second barrier rib crossing the first barrier rib. A diameter of the exhaust hole in a direction parallel to the second electrode may be smaller than a width of the first discharge cell and a width of the second discharge cell.

Each of the second electrode corresponding to the first discharge cell and the second electrode corresponding to the second discharge cell may include a convex portion in the opposite direction to the exhaust hole.

The second electrode corresponding to the first discharge cell or the second electrode corresponding to the second discharge cell may include a convex portion in the opposite direction to the exhaust hole.

In another aspect, there is a multi plasma display panel comprising, a plurality of plasma display panels positioned adjacent to one another, each of the plurality of plasma display panels including a front substrate on which a first electrode is positioned, a rear substrate on which a second electrode crossing the first electrode is positioned, a barrier rib between the front substrate and the rear substrate, the barrier rib providing a plurality of discharge cells, the barrier rib including a first barrier rib parallel to the first electrode and a second barrier rib crossing the first barrier rib, and an exhaust hole on the rear substrate, the exhaust hole being formed in a crossing portion of the first barrier rib and the second barrier rib.

The exhaust hole may be plural.

A size of at least one of a plurality of discharge cells adjacent to the exhaust hole may be smaller than a size of at least one of a plurality of discharge cells that are not adjacent to the exhaust hole.

A diameter of the exhaust hole in a direction parallel to the first electrode may be smaller than a width of the discharge cell.

The second electrode may include a convex portion in the opposite direction to the exhaust hole, and the convex portion may overlap the barrier rib.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
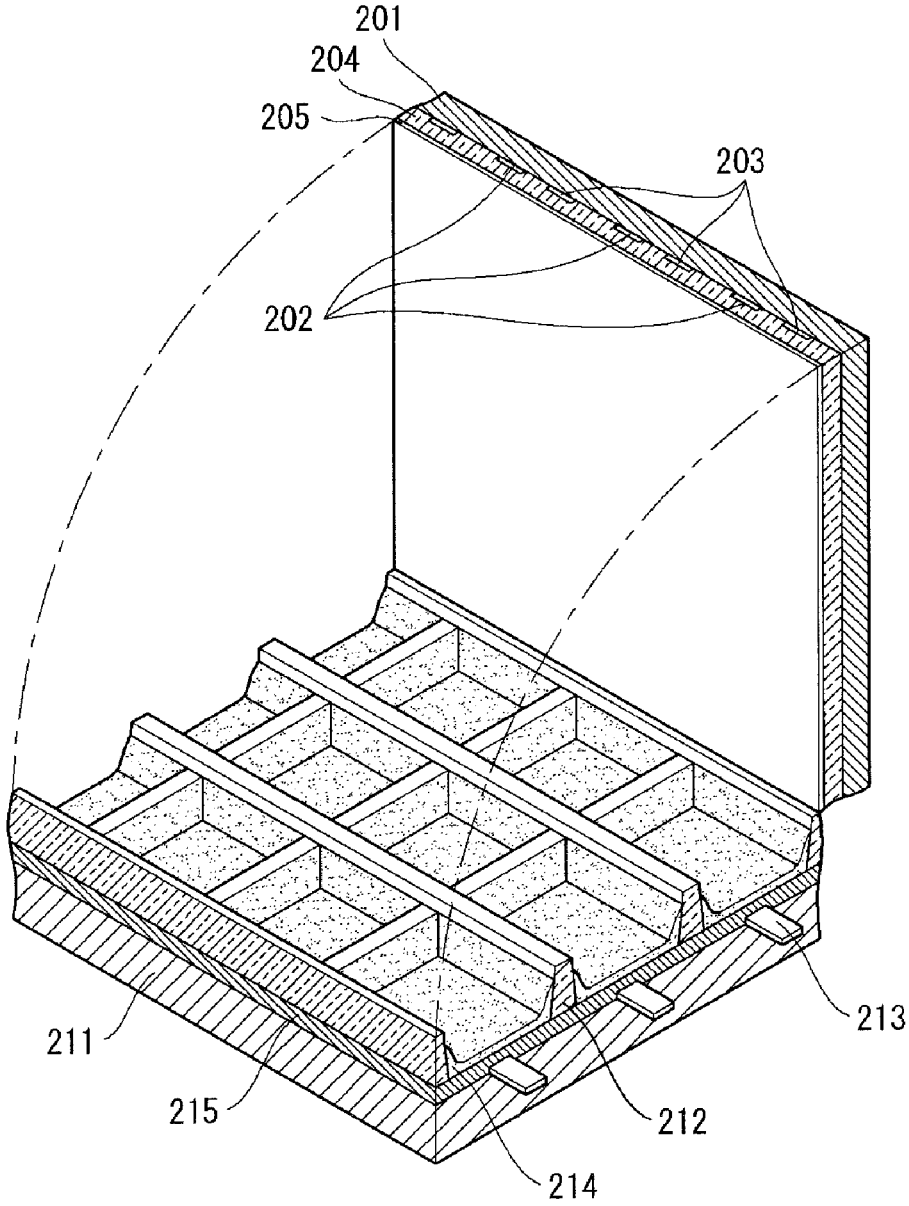
FIGS. 1 to 3 illustrate a structure and a driving method of a plasma display panel according to an embodiment of the invention.
Figure 2:
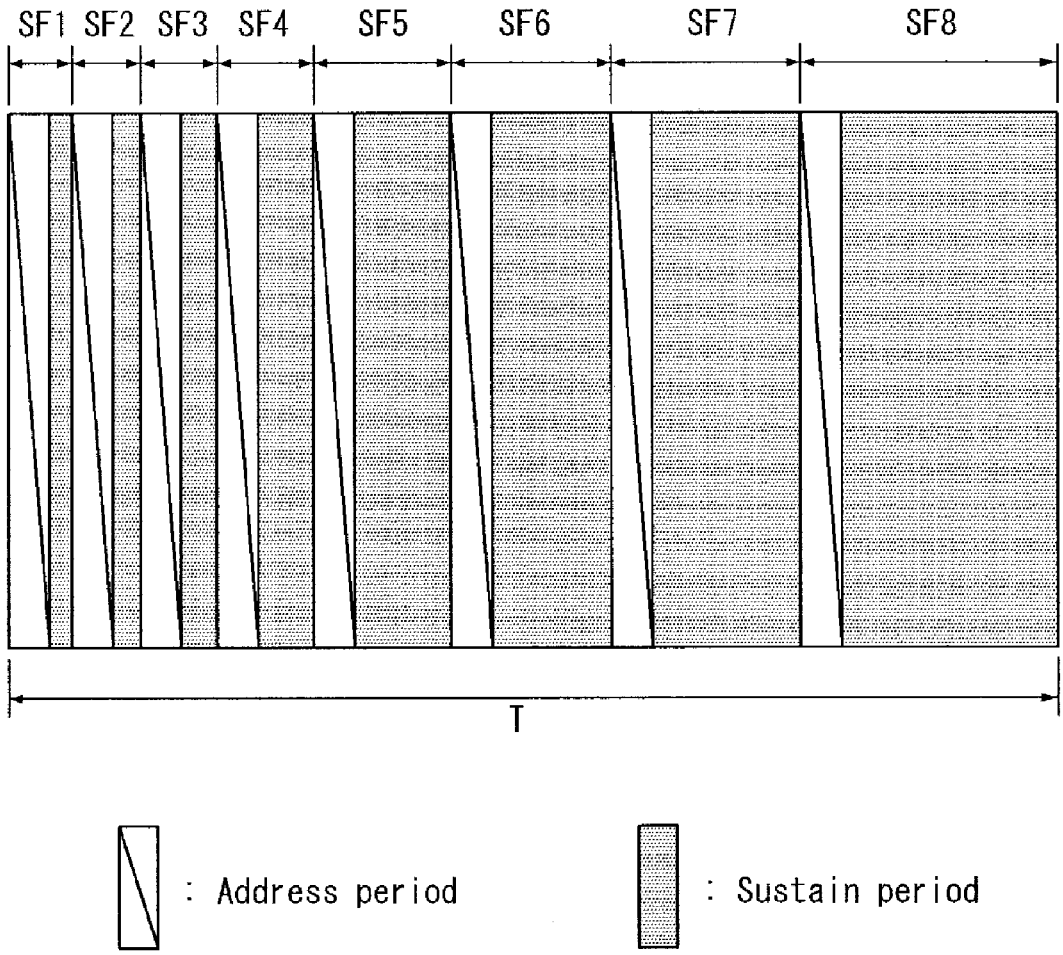
Figure 3:
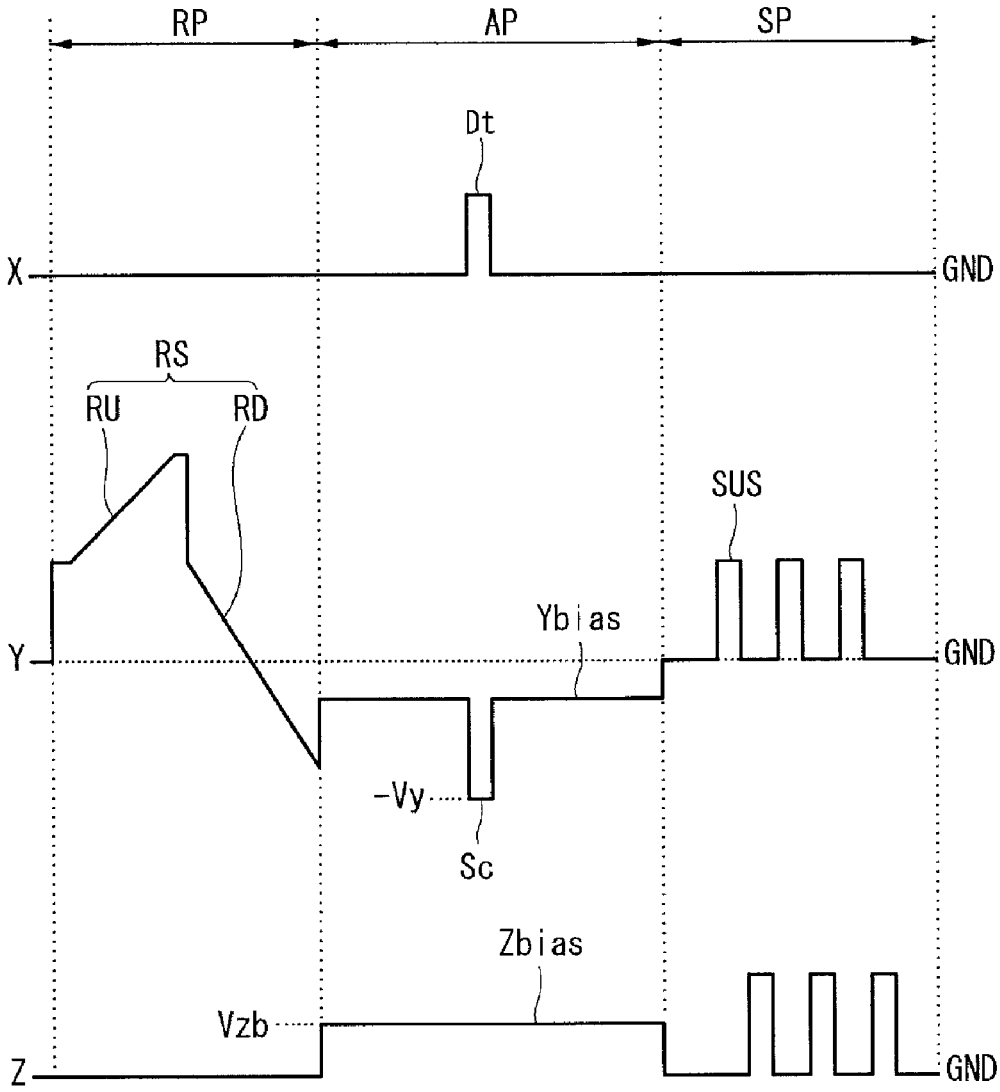

FIGS. 1 to 3 illustrate a structure and a driving method of a plasma display panel according to an embodiment of the invention.

A plasma display panel may display an image in a frame including a plurality of subfields.

More specifically, as shown in FIG. 1, the plasma display panel may include a front substrate 201, on which a plurality of first electrodes 202 and 203 are formed, and a rear substrate 211 on which a plurality of second electrodes 213 are formed to cross the first electrodes 202 and 203.

In FIGS. 1 to 3, the first electrodes 202 and 203 may include scan electrodes 202 and sustain electrodes 203 substantially parallel to each other, and the second electrodes 213 may be called address electrodes.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203.

A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to provide discharge spaces (i.e., discharge cells). Hence, a first discharge cell emitting red light, a second discharge cell emitting blue light, and a third discharge cell emitting green light, etc. may be formed between the front substrate 201 and the rear substrate 211. Each of the barrier ribs 212 may include first and second barrier ribs each having a different height.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells provided by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

A frame for achieving a gray scale of an image displayed on the plasma display panel is described with reference to FIG. 2.

As shown in FIG. 2, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 2, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^0$ and a gray level of a second subfield at $2^1$, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 2 shows that one frame includes 8 subfields, the number of subfields constituting a frame may vary. For example, a frame may include 10 or 12 subfields. Further, although FIG. 2 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

A driving waveform for driving the plasma display panel is illustrated in FIG. 3.

As shown in FIG. 3, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal. RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, . . . , 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS may be alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

Figure 4:
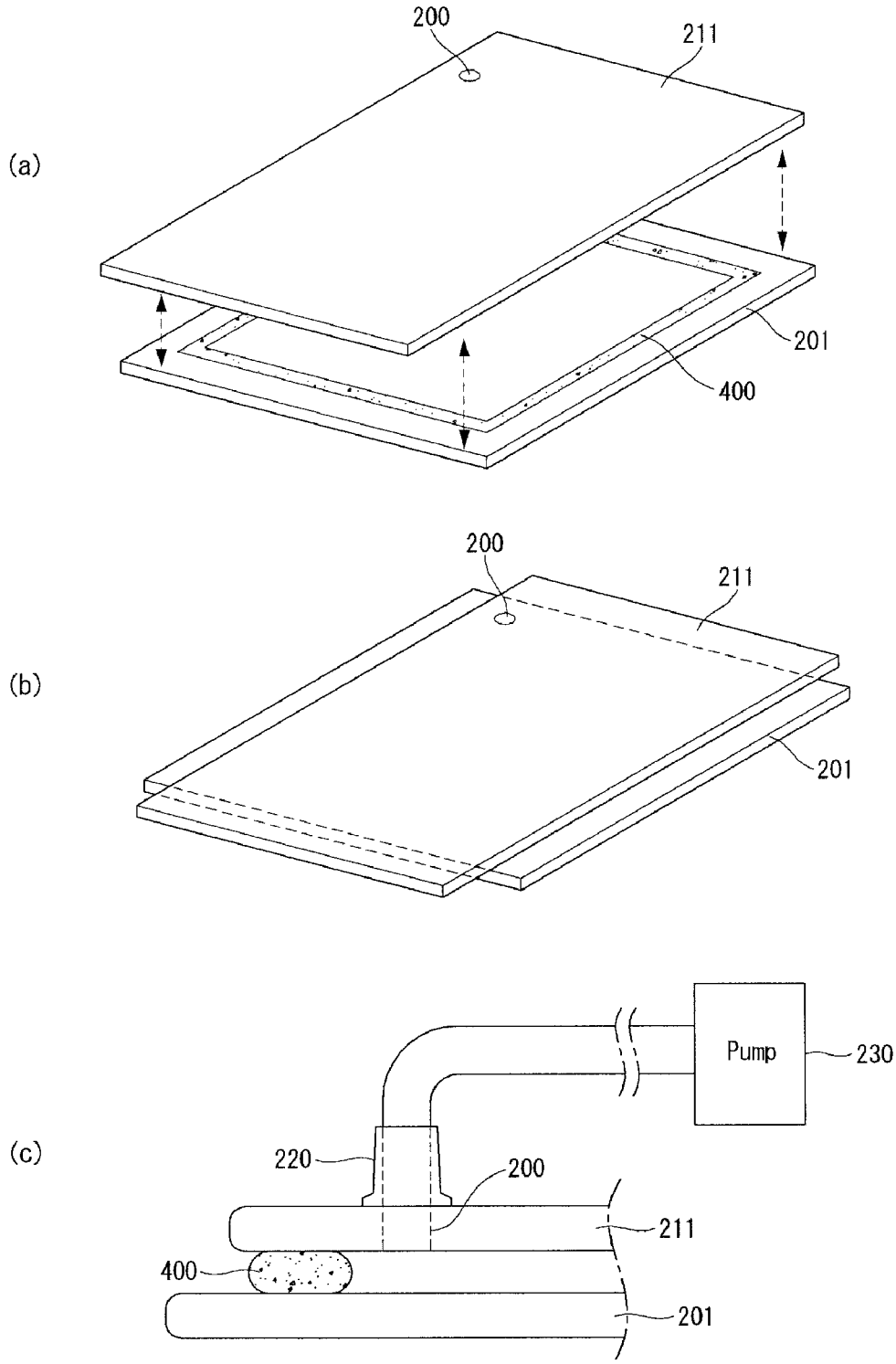
FIG. 4 illustrates a method of manufacturing a plasma display panel according to an embodiment of the invention.

FIG. 4 illustrates a method of manufacturing the plasma display panel according to the embodiment of the invention.

As shown in (a) of FIG. 4, a seal layer 400 may be formed at an edge of at least one of the front substrate 201 and the rear substrate 211 on which an exhaust hole 200 is formed. Thus, as shown in (b) of FIG. 4, the front substrate 201 and the rear substrate 211 may be attached to each other through the seal layer 400.

Subsequently, as shown in (c) of FIG. 4, an exhaust tip may be connected to the exhaust hole 200, and an exhaust pump may be connected to the exhaust tip. The exhaust pump may exhaust an impurity gas remaining in a discharge space between the front substrate 201 and the rear substrate 211 to the outside and may inject a discharge gas, such as argon (Ar), neon (Ne), and xenon (Xe), into the discharge space. The discharge space between the front substrate 201 and the rear substrate 211 may be sealed through the above-described method.

FIGS. 5 to 15 illustrate a configuration of a plasma display panel according to an embodiment of the invention.

Figure 5:
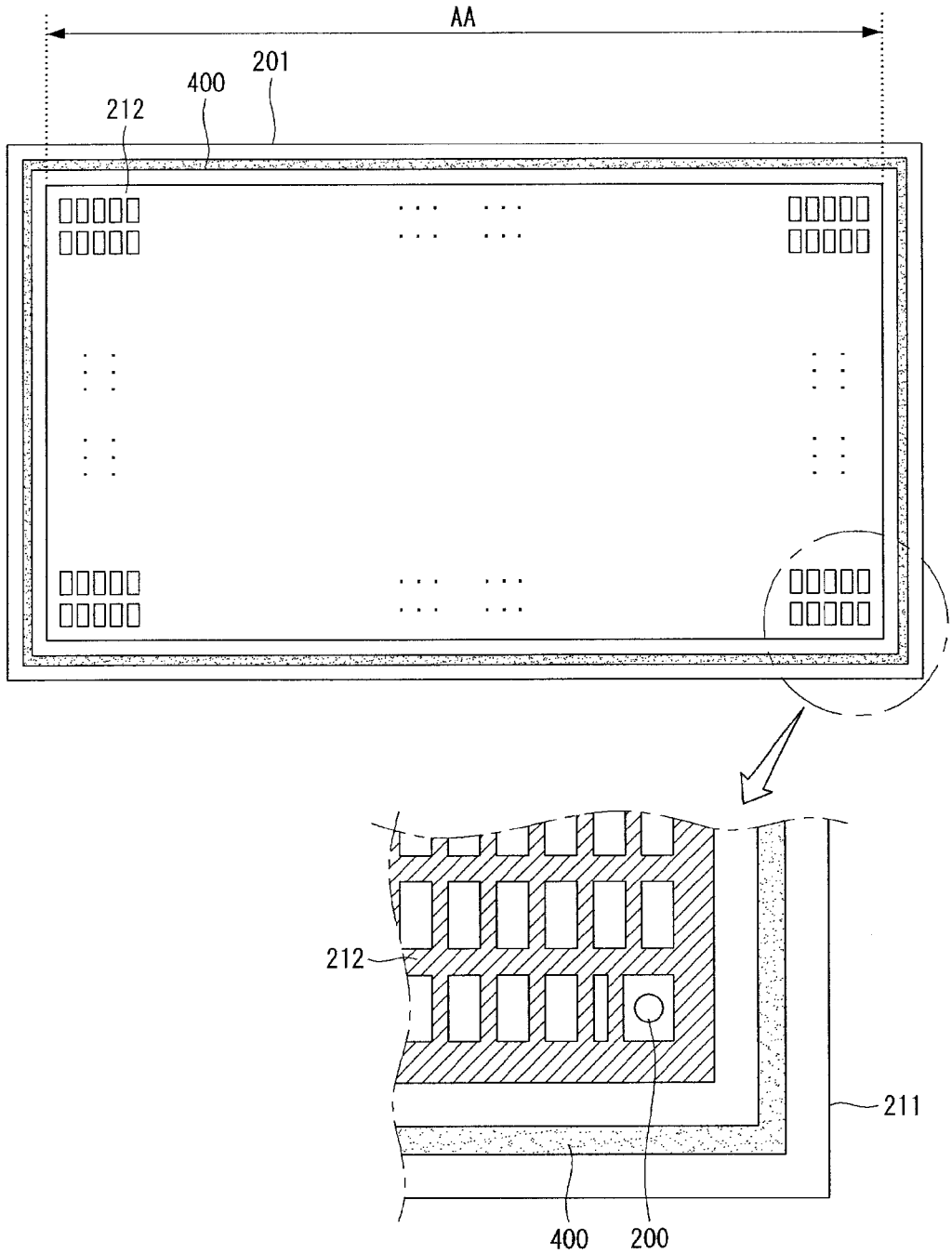
FIGS. 5 to 15 illustrate a configuration of a plasma display panel according to an embodiment of the invention.

As shown in FIG. 5, the exhaust hole 200 may be formed in at least one of the plurality of discharge cells. Preferably, the exhaust hole 200 may be formed in a discharge cell positioned at an edge of an active area AA. Although the embodiment illustrates the circular exhaust hole 200, the exhaust hole 200 may have various shapes such as an oval and a polygon.

As above, when the exhaust hole 200 may be formed in at least one of the discharge cells of the active area AA, the size of the portion on which the image is not displayed may be reduced.

A dummy area is formed outside the active area AA, and a discharge cell (i.e., a dummy discharge cell) not used to achieve the image is positioned in the dummy area. The exhaust hole 200 may be formed in the dummy discharge cell positioned in the dummy area. In this case, the size of the portion on which the image is not displayed may be reduced.

A size of the discharge cell in which the exhaust hole 200 is formed may be greater than a size of at least one of the discharge cells in which the exhaust hole 200 is not formed.

Figure 6:
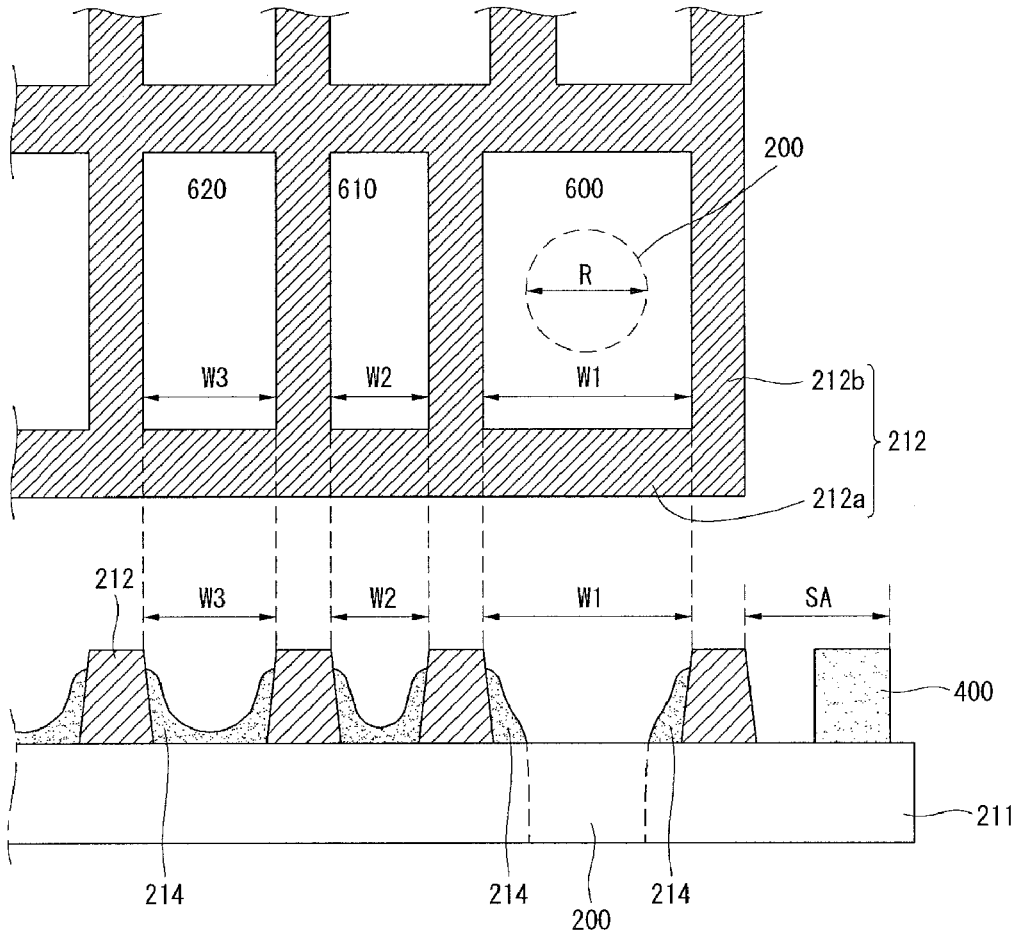

For example, as shown in FIG. 6, the exhaust hole 200 may be formed in a first discharge cell 600, and the exhaust hole 200 may not be formed in a second discharge cell 610 adjacent to the first discharge cell 600. In this case, a size of the first discharge cell 600 may be greater than a size of the second discharge cell 610.

Further, a distance W1 between second barrier ribs 212*b* in the first discharge cell 600 may be greater than a distance W2 between second barrier ribs 212*b* in the second discharge cell 610, so that the size of the first discharge cell 600 is greater than the size of the second discharge cell 610. The second barrier rib 212*b* is positioned parallel to the second electrode (i.e., the address electrode) and may be called a longitudinal barrier rib.

A first barrier rib 212*a* crossing the second barrier rib 212*b* is positioned parallel to the first electrode (i.e., the scan electrode and the sustain electrode) and may be called a transverse barrier rib. Although the embodiment illustrates that the barrier rib 212 includes the first and second barrier ribs 212*a* and 212*b* crossing each other and the first and second barrier ribs 212*a* and 212*b* partition the discharge cells, the barrier rib 212 may have a stripe shape. This is described below.

The exhaust hole 200 is not formed in a third discharge cell 620 that is not adjacent to the first discharge cell 600. A size of the third discharge cell 620 may be less than the size of the first discharge cell 600 and may be greater than the size of the second discharge cell 610. In other words, a distance W2 between second barrier ribs 212*b* in the third discharge cell 620 may be greater than the distance W2 between the second barrier ribs 212*b* in the second discharge cell 610.

As shown in FIG. 6, the size of the second discharge cell 610 adjacent to the first discharge cell 600 may decrease and the size of the third discharge cell 620 that is not adjacent to the first discharge cell 600 may not change (i.e., may not increase and decrease), so that the size of the first discharge cell 600, in which the exhaust hole 200 is formed, increases.

A diameter R of the exhaust hole 200 may be greater than the width W2 of the second discharge cell 610 so as to increase exhaust efficiency. More specifically, the diameter R of the exhaust hole 200 in a direction parallel to the first barrier rib 212*a* may be greater than the width W2 of the second discharge cell 610 in the direction parallel to the first barrier rib 212*a*.

The exhaust hole 200 may be formed in an outermost discharge cell of the plurality of discharge cells so as to reduce a possibility that an observer may perceive the discharge cell in which the exhaust hole 200 is formed. Preferably, the exhaust hole 200 may be formed in an outermost discharge cell in the direction parallel to the first barrier rib 212*a*. In the embodiment, the outermost discharge cell may indicate a discharge cell adjacent to the seal layer 400 and may be positioned in the active area AA in which an image is displayed.

Alternatively, the outermost discharge cell may be positioned in the dummy area in which the image is not displayed. In this case, data may not be supplied to the outermost discharge cell.

Because the size of the first discharge cell 600 in which the exhaust hole 200 is formed is greater than the sizes of the other discharge cells in which the exhaust hole 200 is not formed, the observe may easily perceive the state of the first discharge cell 600 if the first discharge cell 600 is not turned on. Thus, it may be preferable that the phosphor layer 214 is formed in the first discharge cell 600. Further, the phosphor layer 214 may not be formed in the first discharge cell 600 in consideration of advantages in a manufacturing process.

Figure 7:
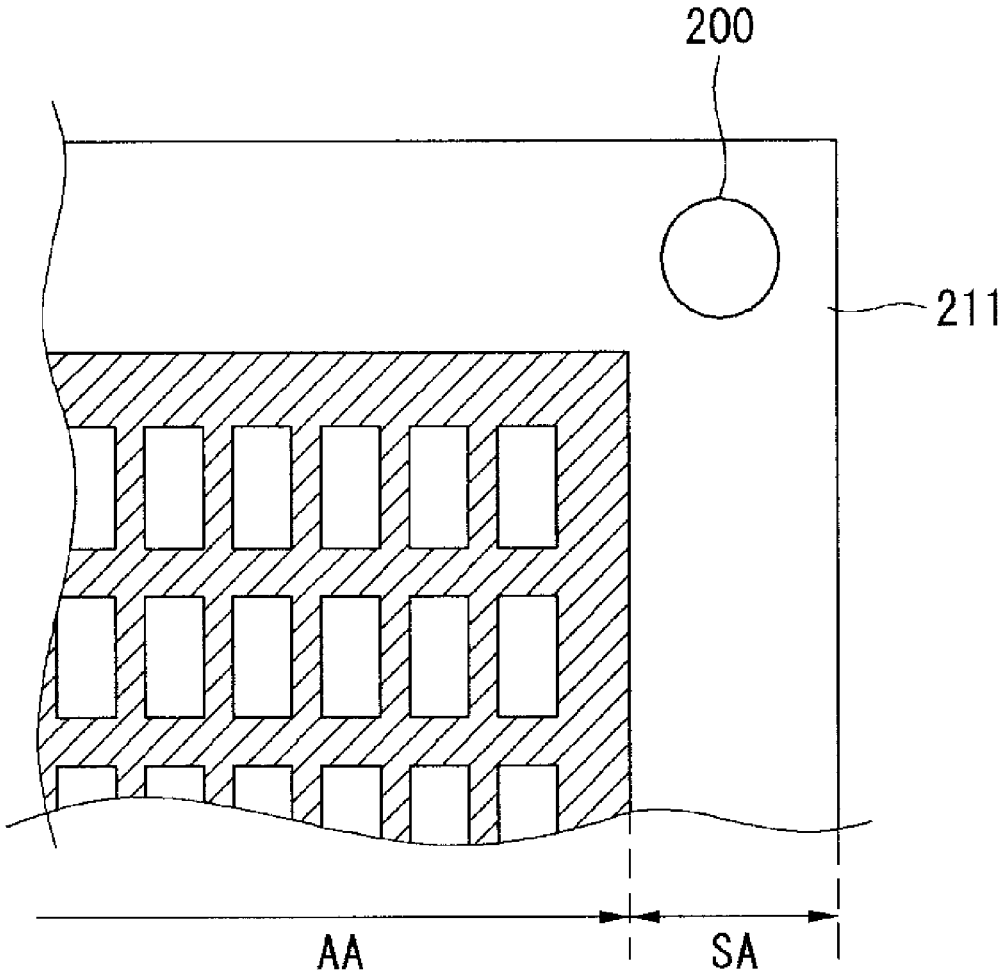

FIG. 7 illustrates a first comparative example of the plasma display panel according to the embodiment of the invention.

As shown in FIG. 7, the exhaust hole 200 is not formed in a discharge cell positioned in an active area AA and is formed in an area SA, in which an image is not displayed, outside the active area AA. In this case, a size of the area SA, in which the image is not displayed, may excessively increase because of the exhaust hole 200.

Figure 8:
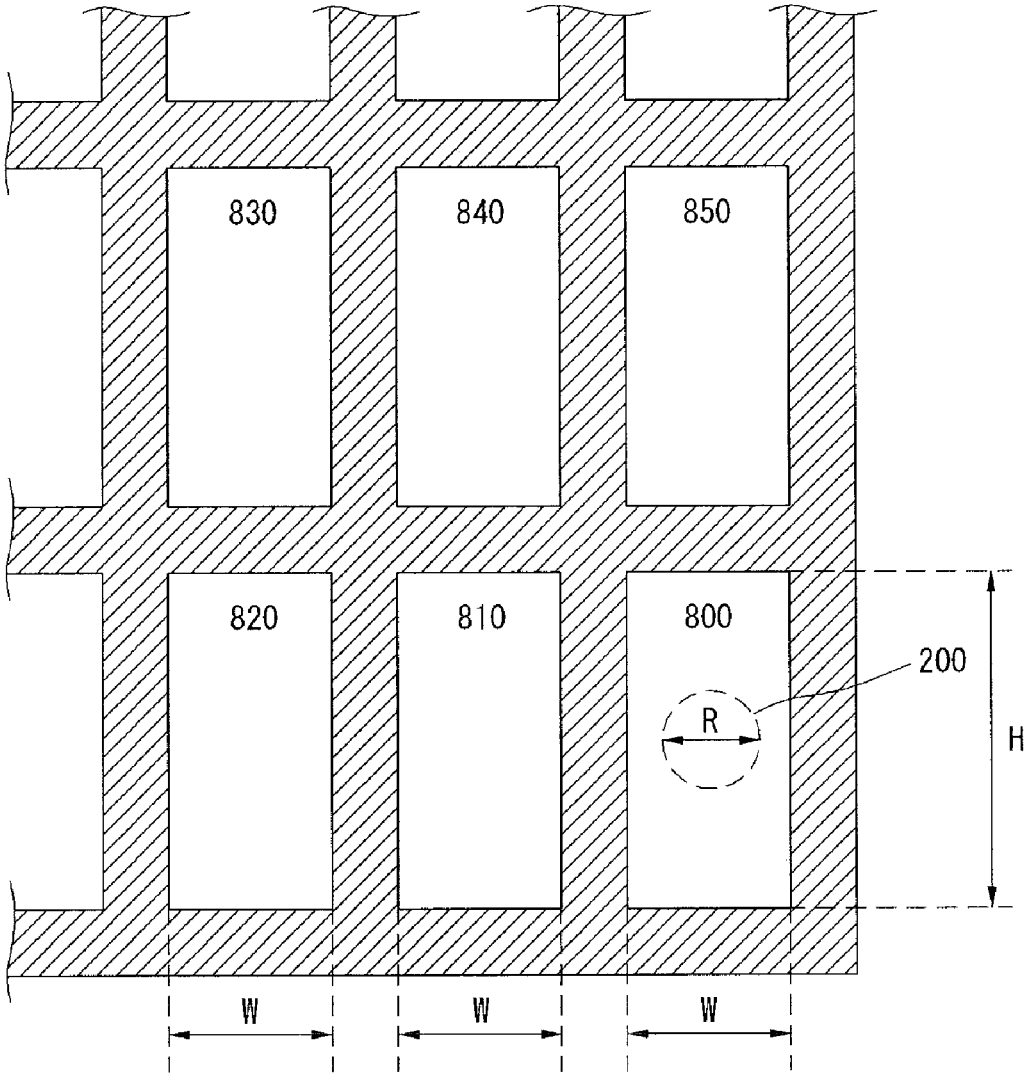

FIG. 8 illustrates a second comparative example of the plasma display panel according to the embodiment of the invention.

As shown in FIG. 8, a size of a discharge cell 800 in which the exhaust hole 200 is formed is substantially equal to sizes of other discharge cells 810, 820, 830, 840, and 850. In this case, the exhaust hole 200 may have an excessively small diameter R, and thus the exhaust efficiency may be reduced. In other words, an impurity gas inside the panel is not sufficiently emitted to the outside of the panel in an exhaust process, or time required to perform the exhaust process excessively increases.

On the other hand, as shown in FIG. 6, when the size of the first discharge cell 600 in which the exhaust hole 200 is formed is greater than the sizes of the other discharge cells in which the exhaust hole 200 is not formed, a size of an area SA in which the image is not displayed may be reduced. Thus, the exhaust efficiency may be improved while reducing the size of a bezel.

Figure 9:
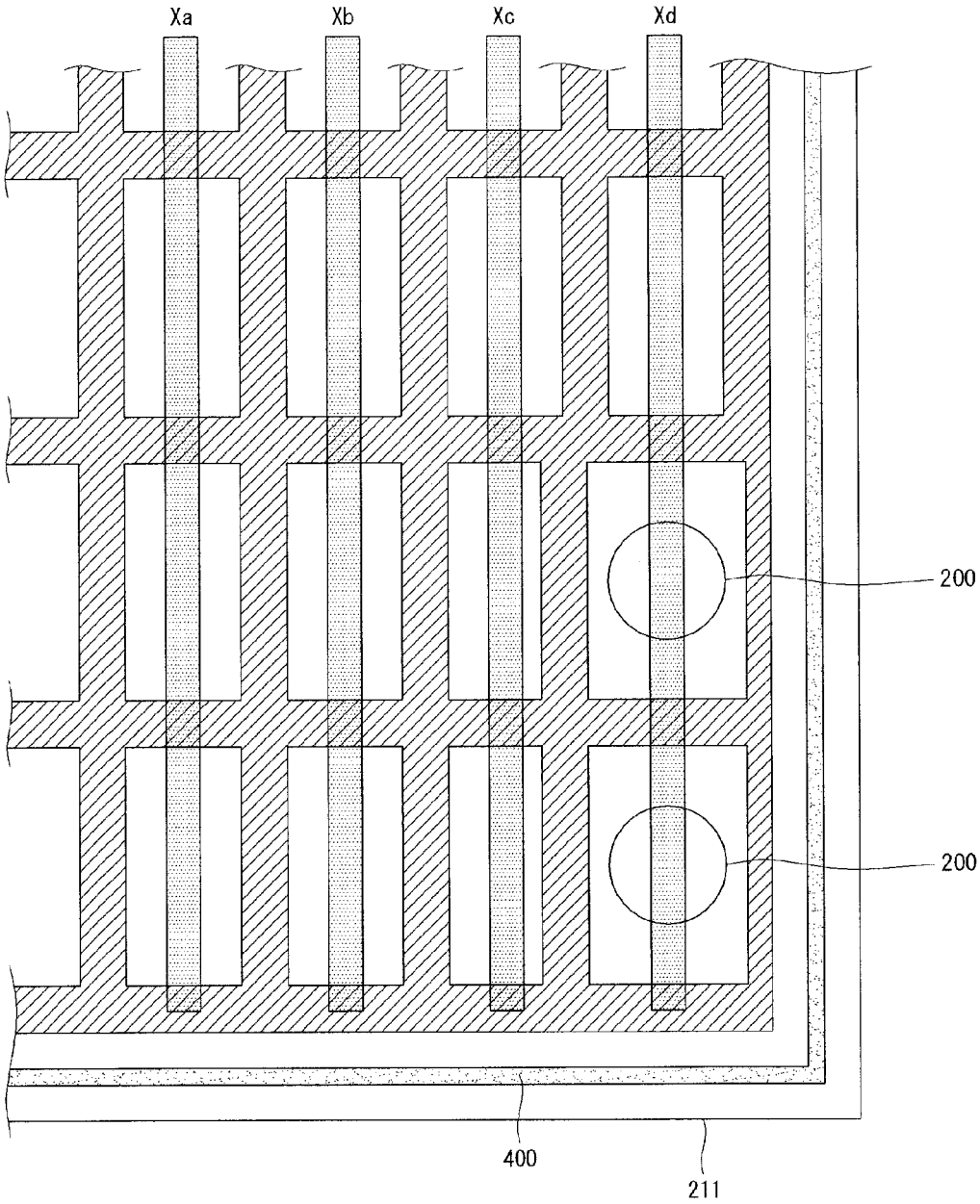

As shown in FIG. 9, the plurality of exhaust holes 200 may be formed in different discharge cells. In this case, the exhaust efficiency may be further improved.

In the plasma display panel according to the embodiment of the invention, a longitudinal width of the discharge cell is greater than a transverse width of the discharge cell. Thus, the discharge cells in which the exhaust holes 200 are formed may be positioned in a direction parallel to second electrodes Xa to Xd, so as to reduce a possibility that the observer may perceive the discharge cells in which the exhaust holes 200 are formed.

Figure 10:
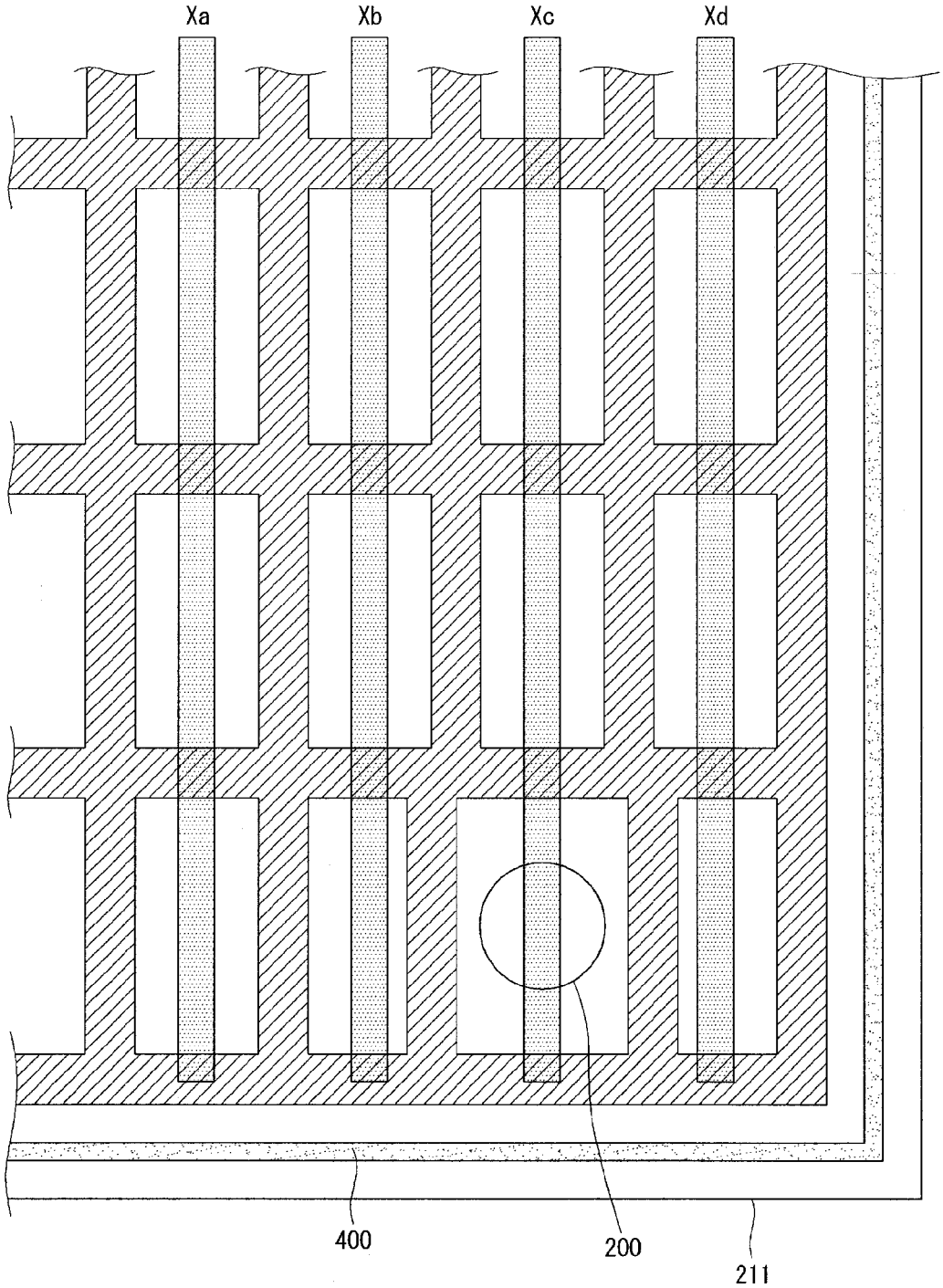

Further, the exhaust hole 200 may be formed in a discharge cell adjacent to an outermost discharge cell. For example, as shown in FIG. 10, the exhaust hole 200 may be formed in a discharge cell adjacent to an outermost discharge cell in a direction crossing the second electrodes Xa to Xd. In other words, the exhaust hole 200 may be formed in a discharge cell corresponding to the second electrode Xc adjacent to the outermost second electrode Xd of the second electrodes Xa to Xd. In this case, because a distance between an end of the exhaust hole 200 and an end of the rear substrate 211 is sufficiently large, the exhaust hole 200 may be easily formed.

Figure 11:
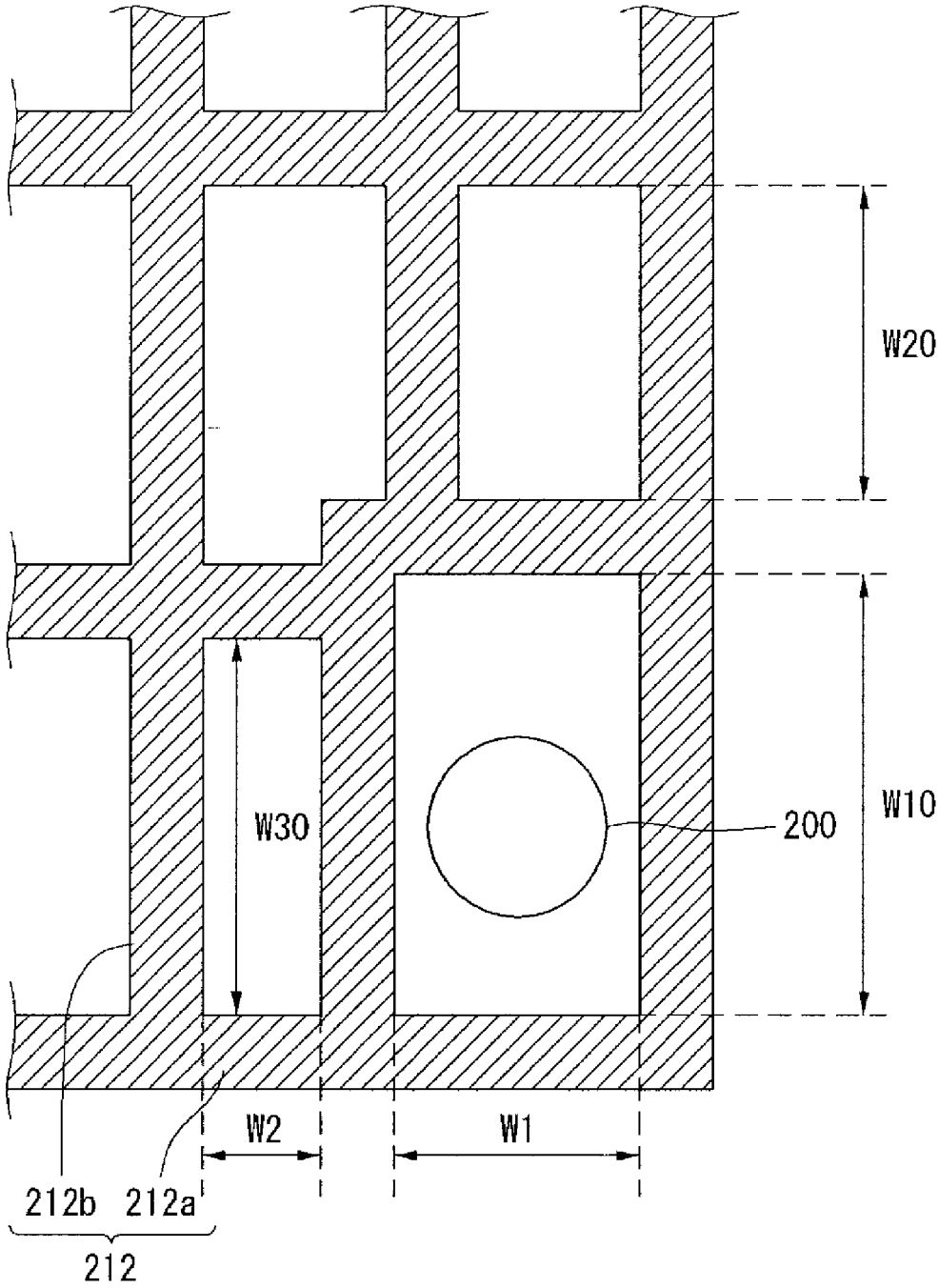

Further, both the transverse and longitudinal widths of the discharge cell in which the exhaust hole 200 is formed may increase so as to increase the size of the discharge cell in which the exhaust hole 200 is formed. For example, as shown in FIG. 11, a transverse width W1 of the discharge cell in which the exhaust hole 200 is formed may be greater than a transverse width W1 of other discharge cells, and a longitudinal width W10 of the discharge cell in which the exhaust hole 200 is formed may be greater than a longitudinal width W20 of other discharge cells.

Figure 12:
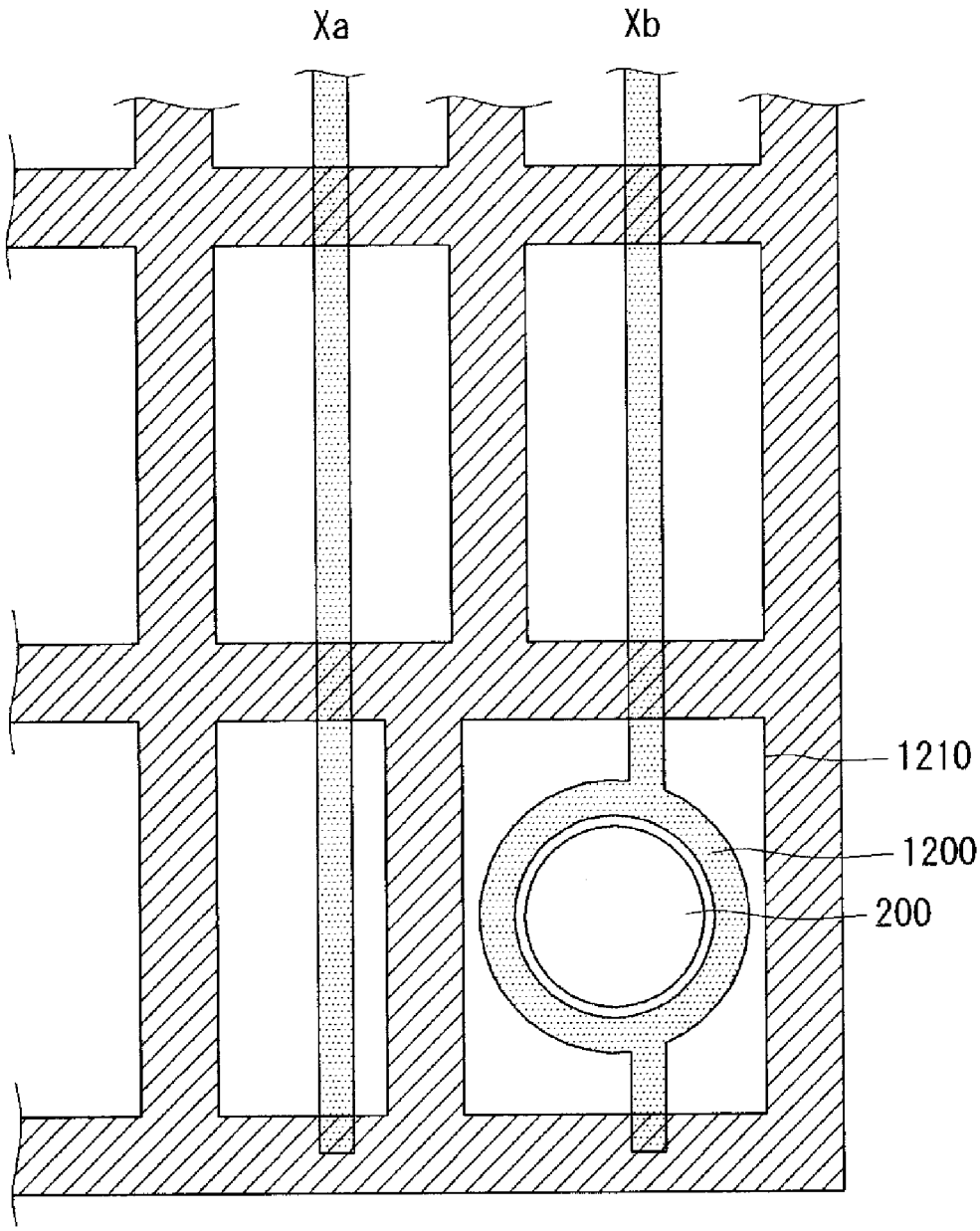

In the discharge cell in which the exhaust hole 200 is formed, the second electrode may include a portion formed around the exhaust hole 200. For example, as shown in FIG. 12, when the exhaust hole 200 is formed in a first discharge cell 1210, a second electrode Xb corresponding to the first discharge cell 1210 may include a portion 1200 formed around the exhaust hole 200 in the first discharge cell 1210.

As above, when the second electrode Xb includes the portion 1200 formed around the exhaust hole 200, a damage of the second electrode Xb resulting from the exhaust hole 200 may be prevented.

Figure 13:
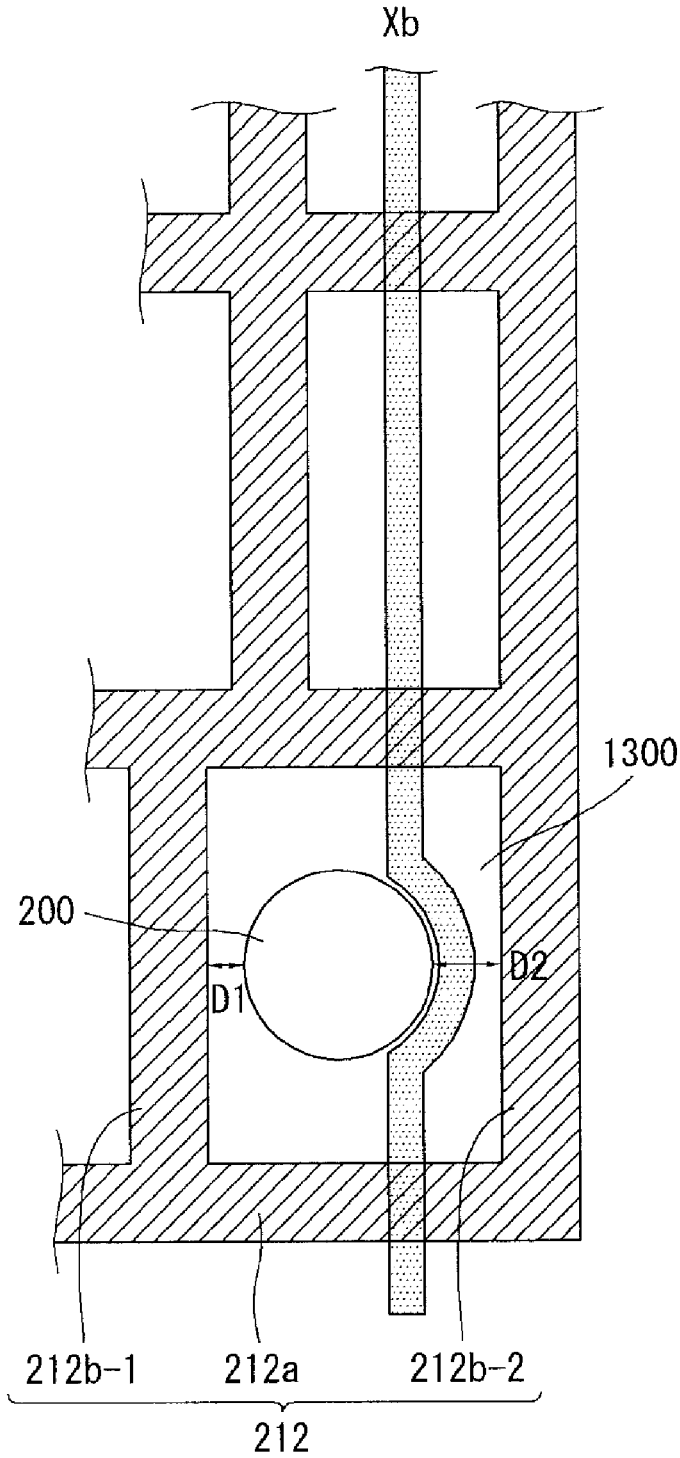

Further, the second electrode Xb may be positioned at one side of the exhaust hole 200. For example, as shown in FIG. 13, it is assumed that the exhaust hole 200 is formed in a first discharge cell 1300, and a distance D1 between a 2-1 barrier rib 212*b*-1 of two second barrier ribs 212*b* providing the first discharge cell 1300 and the exhaust hole 200 is less than a distance D2 between a 2-2 barrier rib 212*b*-2 and the exhaust hole 200. In this case, a sufficient space may be provided between the 2-2 barrier rib 212*b*-2 and the exhaust hole 200. Hence, the second electrode Xb may be positioned in the space between the 2-2 barrier rib 212*b*-2 and the exhaust hole 200. And, the second electrode Xb includes a convex portion in the direction opposite to the exhaust hole 200.

The second barrier rib 212*b* in the discharge cell in which the exhaust hole 200 is formed may protrude in a direction of other discharge cells, so that a size of the discharge cell in which the exhaust hole 200 is formed is greater than sizes of the other discharge cells.

Figure 14:
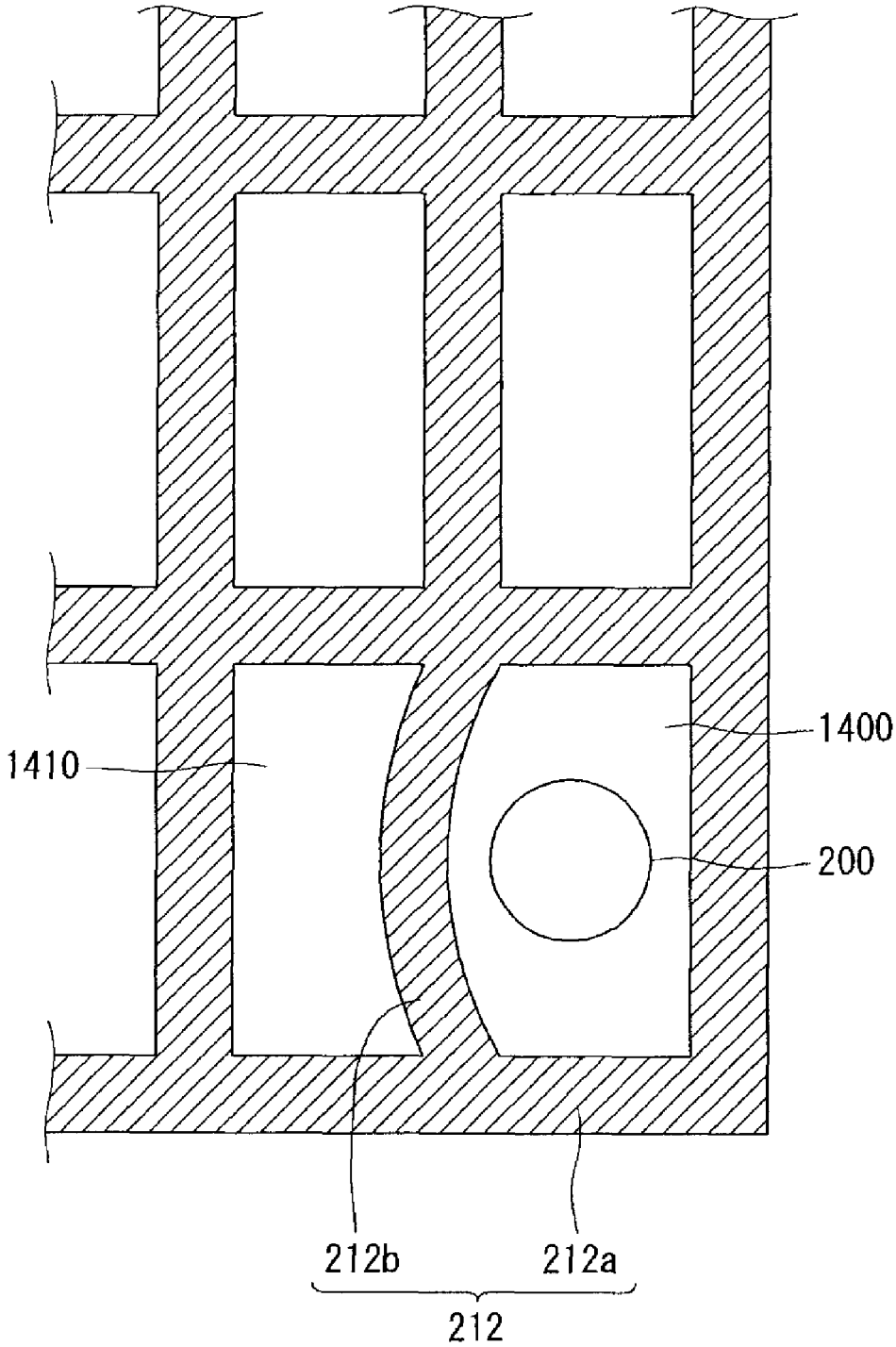

For example, as shown in FIG. 14, it is assumed that the exhaust hole 200 is formed in a first discharge cell 1400, and the exhaust hole 200 is not formed in a second discharge cell 1410 adjacent to the first discharge cell 1400. In this case, a second barrier rib 212*b* between the first discharge cell 1400 and the second discharge cell 1410 may protrude in a direction of the second discharge cell 1410. Hence, a size of the first discharge cell 1400 may be greater than a size of the second discharge cell 1410, and the second barrier rib 212*b* between the first discharge cell 1400 and the second discharge cell 1410 may have gentle curvature.

Figure 15:
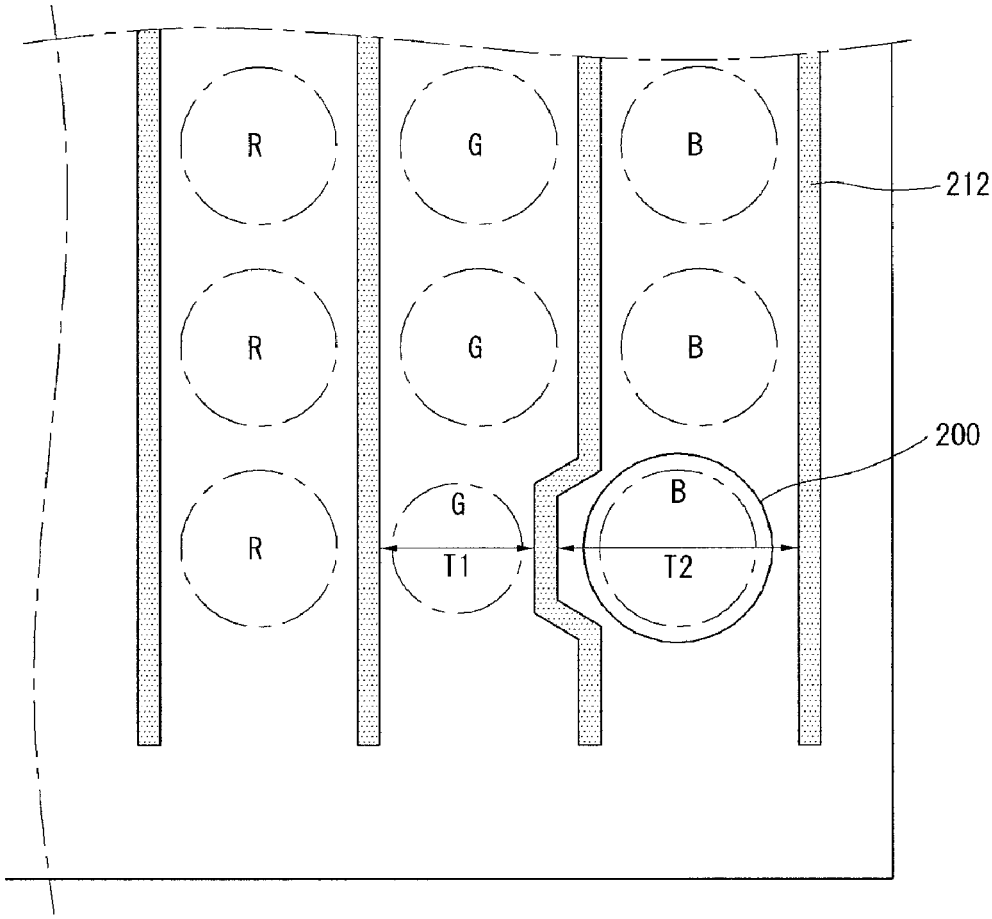

Further, the barrier rib 212 of the plasma display panel according to the embodiment of the invention may have a stripe shape as shown in FIG. 15. As above, when the barrier rib 212 has the stripe shape, a distance T2 between two barrier ribs 212 in a portion in which the exhaust hole 200 is formed is greater than a distance T1 between two barrier ribs 212 in a portion in which the exhaust hole 200 is not formed. Further, when the barrier rib 212 has the stripe shape, the discharge cells may be partitioned by red, green, blue phosphor layers R, G, and B and the first and second electrodes. Thus, even in the example embodiment illustrated in FIG. 15, a width of a discharge cell in which the exhaust hole 200 is formed is greater than a width of a discharge cell adjacent to the discharge cell in which the exhaust hole 200 is formed.

FIGS. 16 to 27 illustrate a configuration of a plasma display panel according to another embodiment of the invention.

Figure 16:
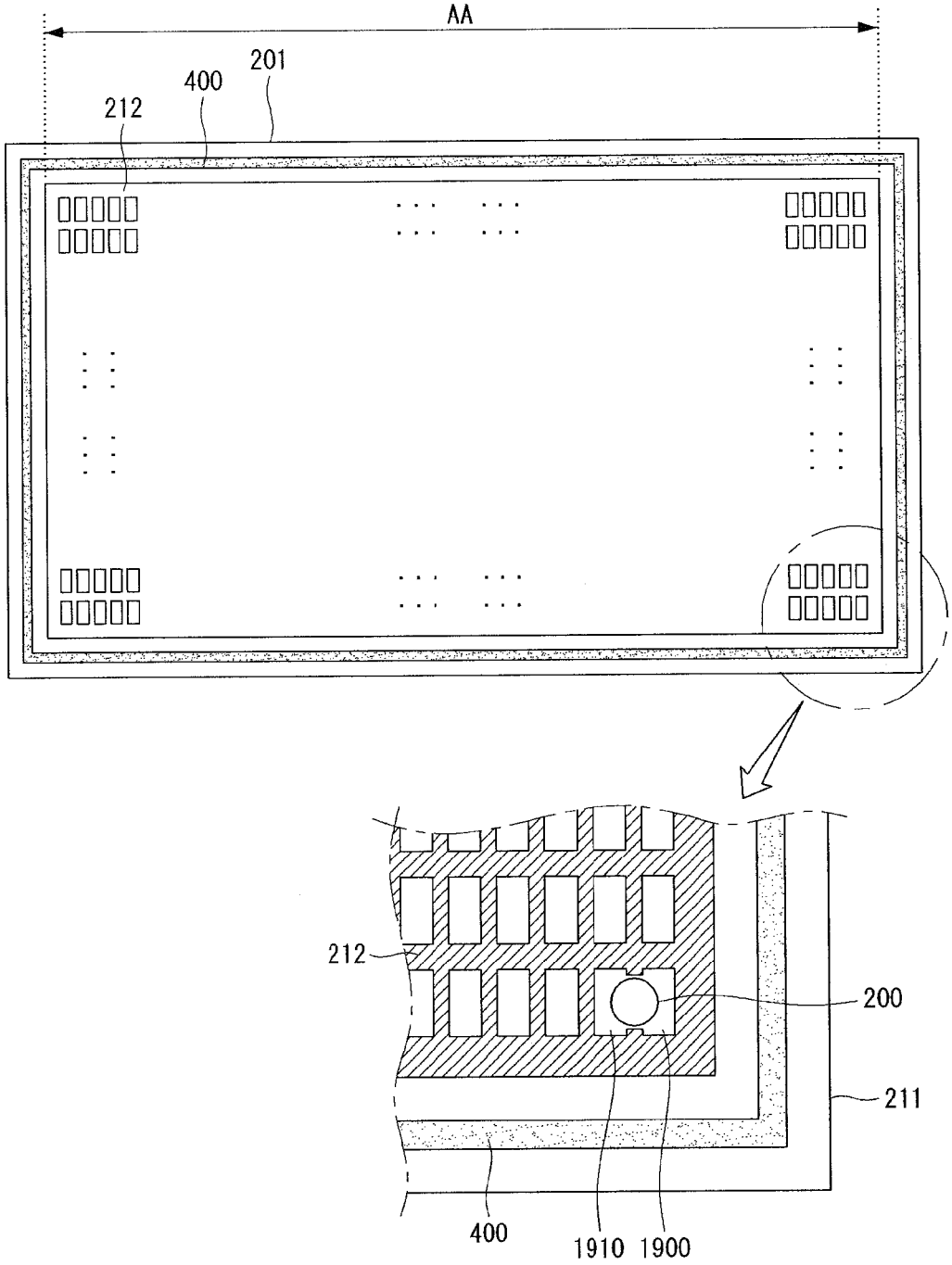
FIGS. 16 to 27 illustrate a configuration of a plasma display panel according to another embodiment of the invention.

As shown in FIG. 16, an exhaust hole 200 may be formed in a portion between at least two discharge cells. Preferably, the exhaust hole 200 may be formed in a portion commonly overlapping at least two discharge cells in a portion between the at least two discharge cells.

As above, when the exhaust hole 200 is formed between at least two discharge cells, the size of a portion on which an image is not displayed may be reduced. Hence, the size of a bezel may be reduced.

Further, two discharge cells positioned adjacent to each other with the exhaust hole 200 interposed between the two discharge cells may be positioned in an active area AA. A dummy area is formed outside the active area AA, and a discharge cell (i.e., a dummy discharge cell) not used to achieve the image is positioned in the dummy area. The exhaust hole 200 may be formed in an area overlapping the dummy area. In this case, the size of the portion on which an image is not displayed may be reduced.

Figure 17:
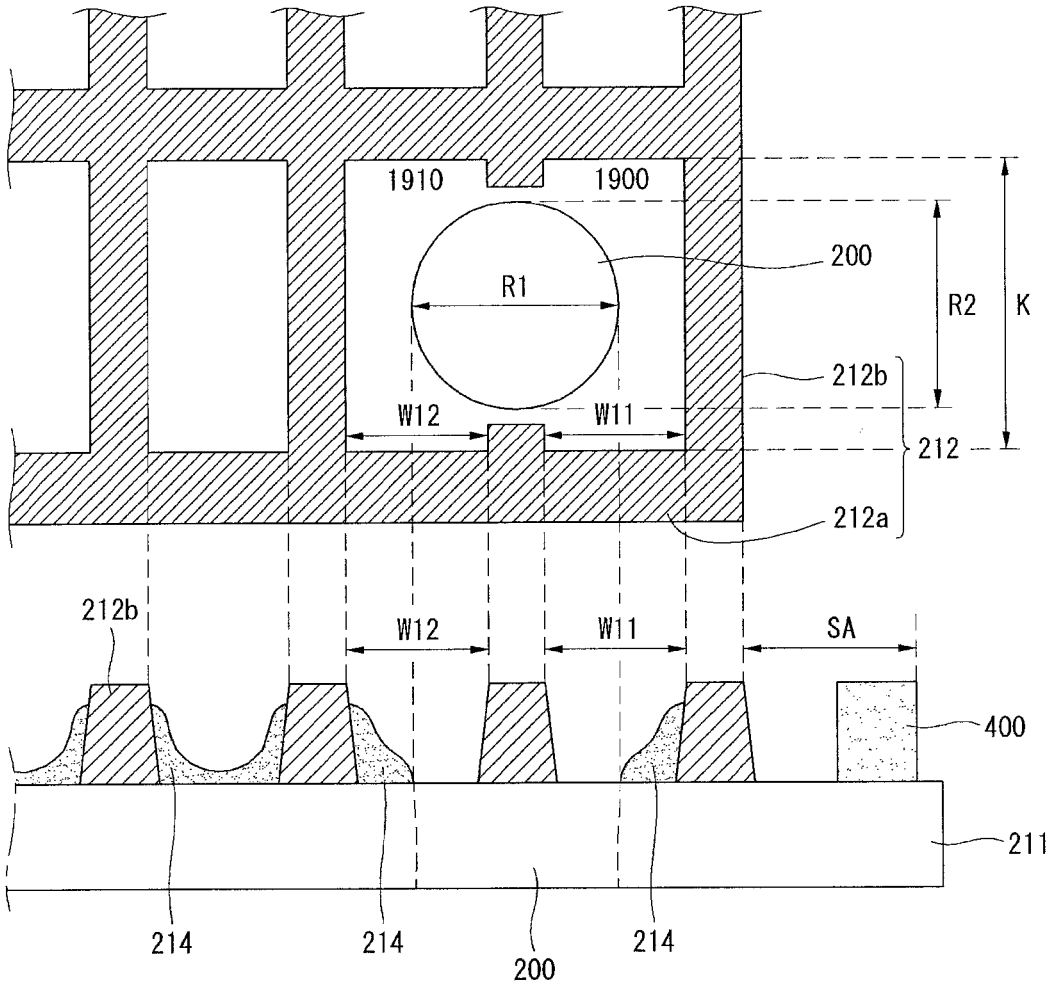

For example, as shown in FIGS. 16 and 17, the exhaust hole 200 may be formed in a portion commonly overlapping first and second discharge cells 1900 and 1910 positioned adjacent to each other. In other words, the exhaust hole 200 may be formed in a portion of the first and second discharge cells 1900 and 1910 positioned adjacent to each other.

A barrier rib 212 between the first and second discharge cells 1900 and 1910 may be divided by the exhaust hole 200. Preferably, as shown in FIG. 17, the barrier rib 212 may include a first barrier rib 212*a* parallel to a first electrode and a second barrier rib 212*b* crossing the first barrier rib 212*a*, and the second barrier rib 212*b* between the first and second discharge cells 1900 and 1910 may be divided by the exhaust hole 200.

A diameter of the exhaust hole 200 may be greater than a width of the first discharge cell 1900 and a width of the second discharge cell 1910 so as to improve exhaust efficiency. More specifically, a diameter R1 of the exhaust hole 200 in a direction parallel to the first barrier rib 212*a* may be greater than a width W11 of the first discharge cell 1900 and a width W12 of the second discharge cell 1910 in the direction parallel to the first barrier rib 212*a*.

When the size of the exhaust hole 200 is excessively large, the observer may easily perceive the exhaust hole 200 and thus may perceive that the image is not partially displayed.

Thus, a diameter R2 of the exhaust hole 200 in a direction parallel to the second barrier rib 212*b* may be less than widths K of the first and second discharge cells 1900 and 1910 in the direction parallel to the second barrier rib 212*b*.

Further, the exhaust hole 200 may be formed between an outermost discharge cell of the plurality of discharge cells and a discharge cell adjacent to the outermost discharge cell, so as to reduce a possibility that the observer may perceive the discharge cell in which the exhaust hole 200 is formed. Preferably, the exhaust hole 200 may be formed between an outermost discharge cell in the direction parallel to the first barrier rib 212*a* and a discharge cell adjacent to the outermost discharge cell.

Because the exhaust hole 200 is formed in a portion of each of the adjacent first and second discharge cells 1900 and 1910, the observe may easily perceive the state of the first and second discharge cells 1900 and 1910 if the first and second discharge cells 1900 and 1910 are not turned on. Thus, it may be preferable that the phosphor layer 213 is formed in at least one of the first and second discharge cells 1900 and 1910. Further, the phosphor layer 214 may not be formed in the first and second discharge cells 1900 and 1910 in consideration of advantages in a manufacturing process.

Figure 18:
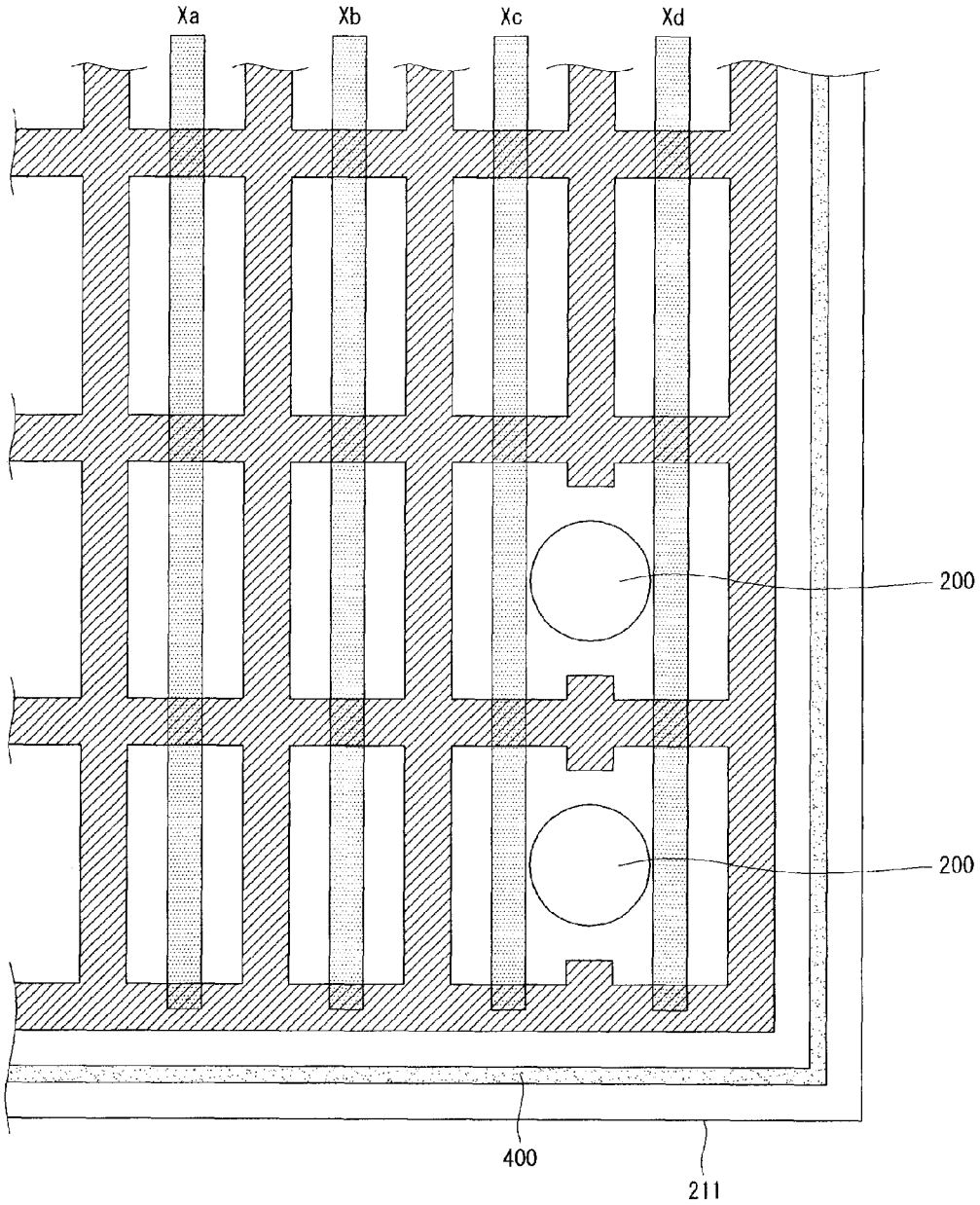

As shown in FIG. 18, a plurality of exhaust holes 200 may be formed. In this case, the exhaust efficiency may be further improved.

In the plasma display panel according to the embodiment of the invention, a longitudinal width of the discharge cell is greater than a transverse width of the discharge cell. Thus, the discharge cells overlapping the exhaust holes 200 may be positioned in a direction parallel to second electrodes Xa to Xd, so as to reduce a possibility that the observer may perceive the discharge cells in which the exhaust holes 200 are formed.

The exhaust hole 200 may be formed between four adjacent discharge cells, i.e., in a portion commonly overlapping the four adjacent discharge cells, so as to sufficiently increase the size of the exhaust hole 200. In this case, at least one first electrode 212*a* as well as at least one second electrode 212*b* may be divided by the exhaust hole 200.

Figure 19:
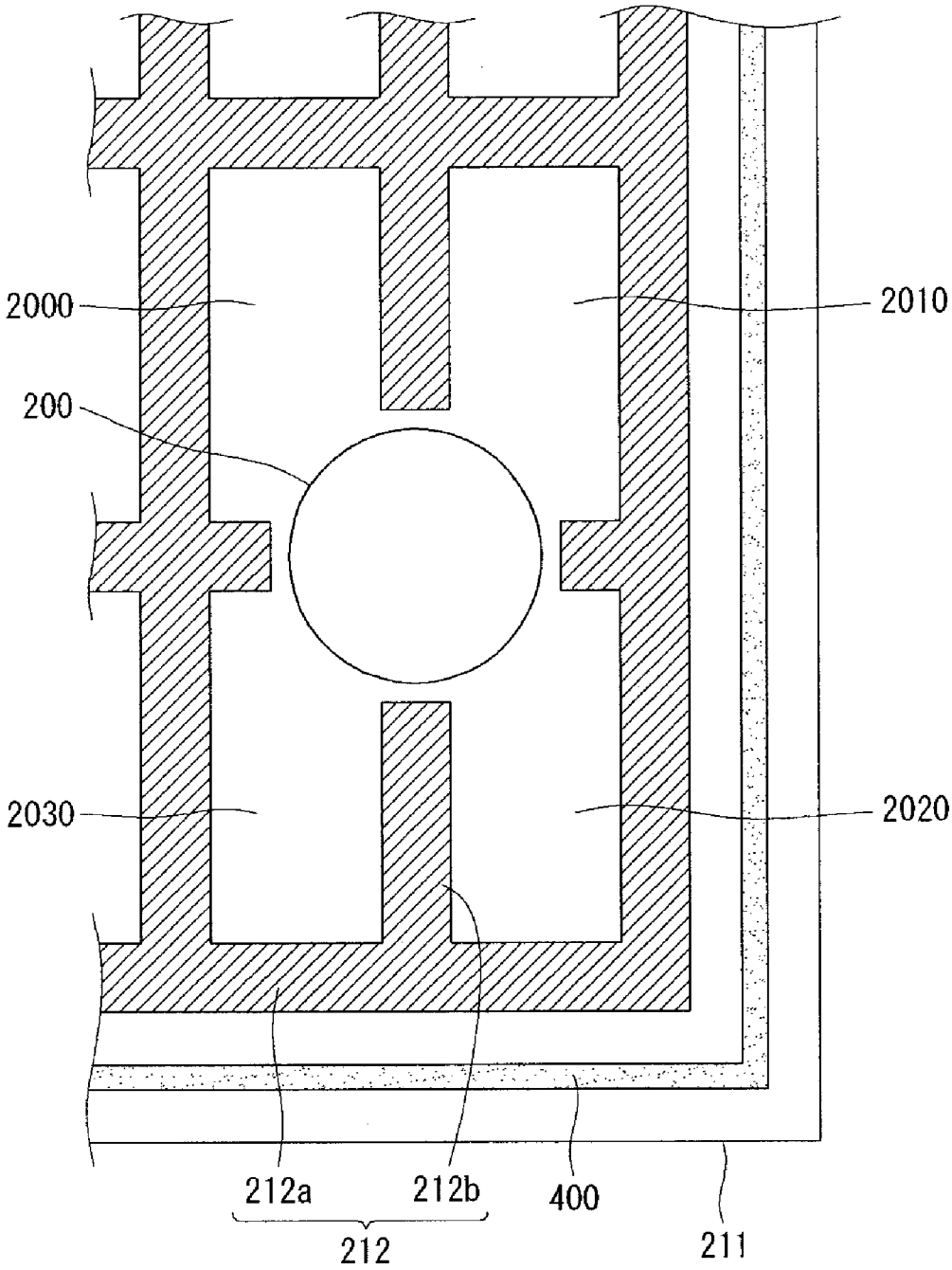

For example, as shown in FIG. 19, it is assumed that the plurality of discharge cells include first, second, third, and fourth discharge cells 2000, 2010, 2020, and 2030 positioned adjacent to one another. In this case, the exhaust hole 200 may be formed in a portion commonly overlapping the first, second, third, and fourth discharge cells 2000, 2010, 2020, and 2030.

The second electrode 212*b* that provides the first and second discharge cells 2000 and 2010 and provides the third and fourth discharge cells 2020 and 2030 may be divided by the exhaust hole 200, and the first electrode 212*a* that provides the first and fourth discharge cells 2000 and 2030 and provides the second and third discharge cells 2010 and 2020 may be divided by the exhaust hole 200.

Figure 20:
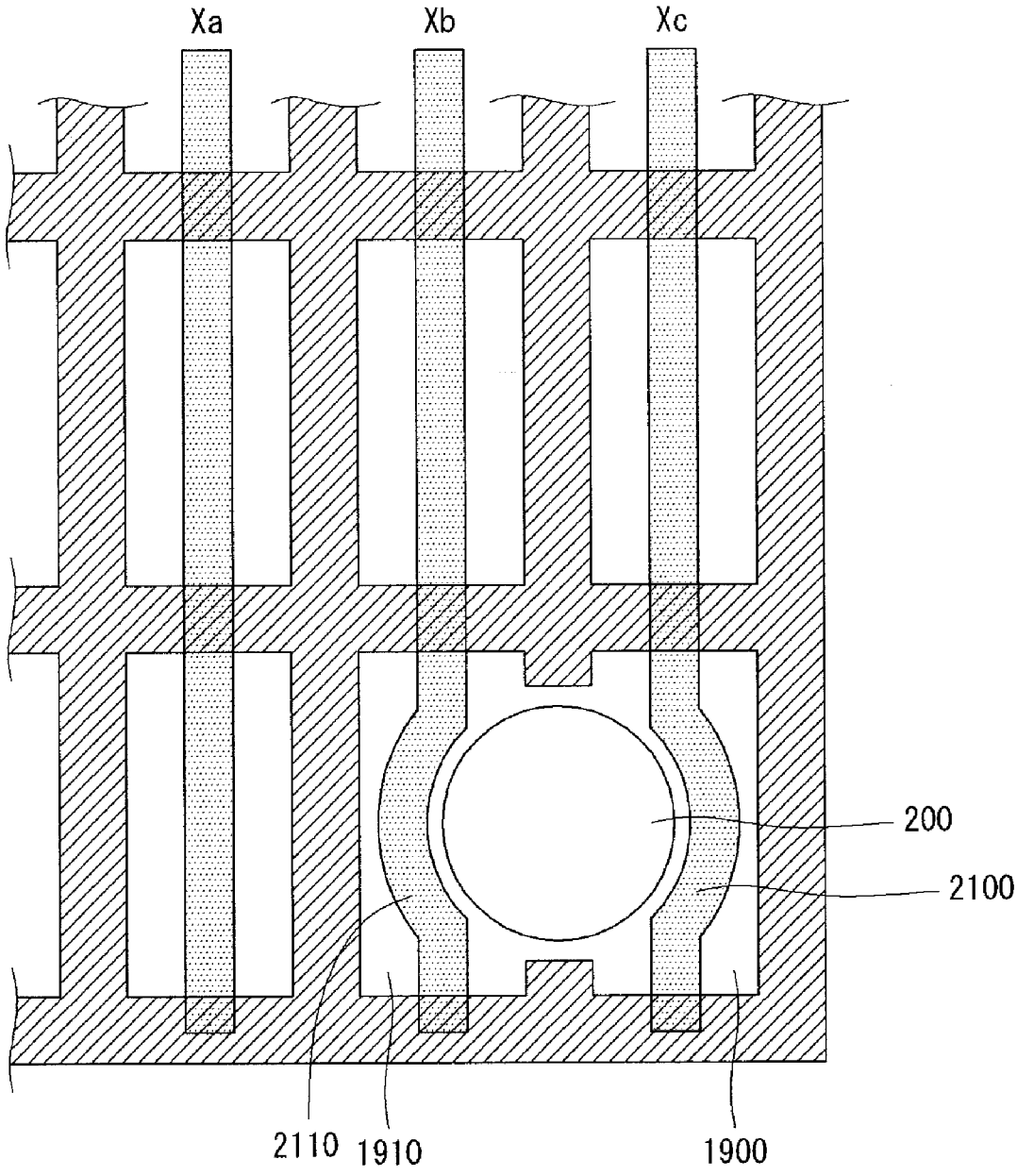

The second electrode may include a portion positioned around the exhaust hole 200 in a formation portion of the exhaust hole 200. For example, as shown in FIG. 20, when the exhaust hole 200 overlaps first and second discharge cells 1900 and 1910, a second electrode Xc corresponding to the first discharge cell 1900 may include a convex portion 2100 in the opposite direction to the exhaust hole 200 in the first discharge cell 1900 and a second electrode Xb corresponding to the second discharge cell 1910 may include a convex portion 2110 in the opposite direction to the exhaust hole 200 in the second discharge cell 1910.

As above, when the second electrodes Xb and Xc include the convex portions 2110 and 2100 positioned around the exhaust hole 200, a damage of the second electrodes Xb and Xc resulting from the exhaust hole 200 may be prevented.

A size of an overlapping portion between one of two adjacent discharge cells and the exhaust hole 200 may be different from a size of an overlapping portion between the other discharge cell and the exhaust hole 200.

Figure 21:
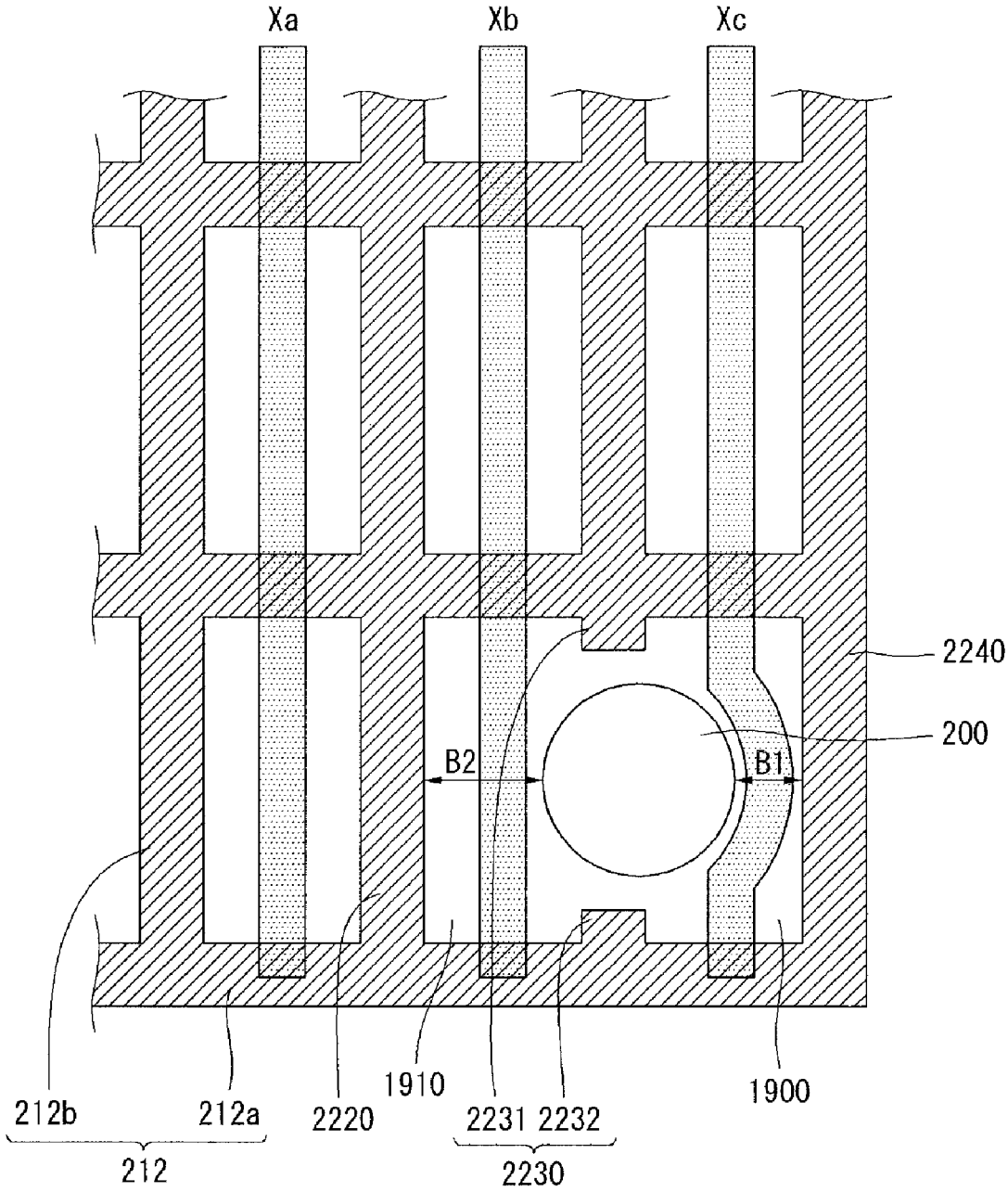

For example, as shown in FIG. 21, a size of an overlapping portion between a first discharge cell 1900 and the exhaust hole 200 may be greater than a size of an overlapping portion between a second discharge cell 1910 and the exhaust hole 200.

In other words, when the second discharge cell 1910 is provided by a 2-1 barrier rib 2220 and a 2-2 barrier rib 2230 of the plurality of second barrier ribs 212*b* and the first discharge cell 1900 is provided by the 2-2 barrier rib 2230 and a 2-3 barrier rib 2240 of the plurality of second barrier ribs 212*b*, a shortest distance B1 between the exhaust hole 200 and the 2-3 barrier rib 2240 may be less than a shortest distance B2 between the exhaust hole 200 and the 2-1 barrier rib 2220. The 2-2 barrier rib 2230 may be divided into two barrier ribs 2231 and 2232 by the exhaust hole 200.

In this case, the second electrode Xc corresponding to the first discharge cell 1900 may include a convexly curved portion, and the second electrode Xb corresponding to the second discharge cell 1910 may not include a convexly curved portion.

Figure 22:
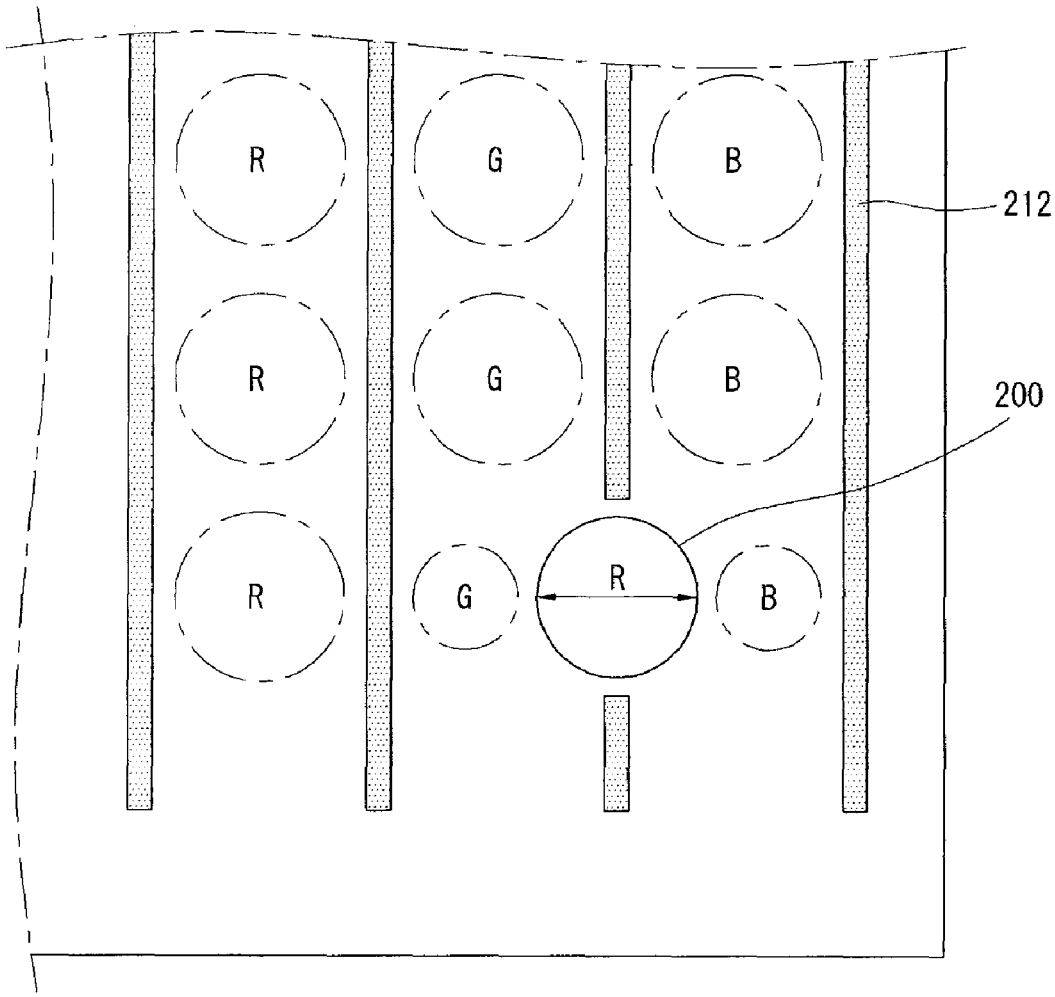

The barrier rib 212 of the plasma display panel according to the embodiment of the invention, as shown in FIG. 22, may have a stripe shape. As above, when the barrier rib 212 has the stripe shape, the barrier rib 212 may be divided in a formation portion of the exhaust hole 200. Further, when the barrier rib 212 has the stripe shape, the discharge cells may be partitioned by red, green, blue phosphor layers R, G, and B and the first and second electrodes. Thus, even in the example embodiment illustrated in FIG. 22, the exhaust hole 200 is formed between two adjacent discharge cells.

Figure 23:
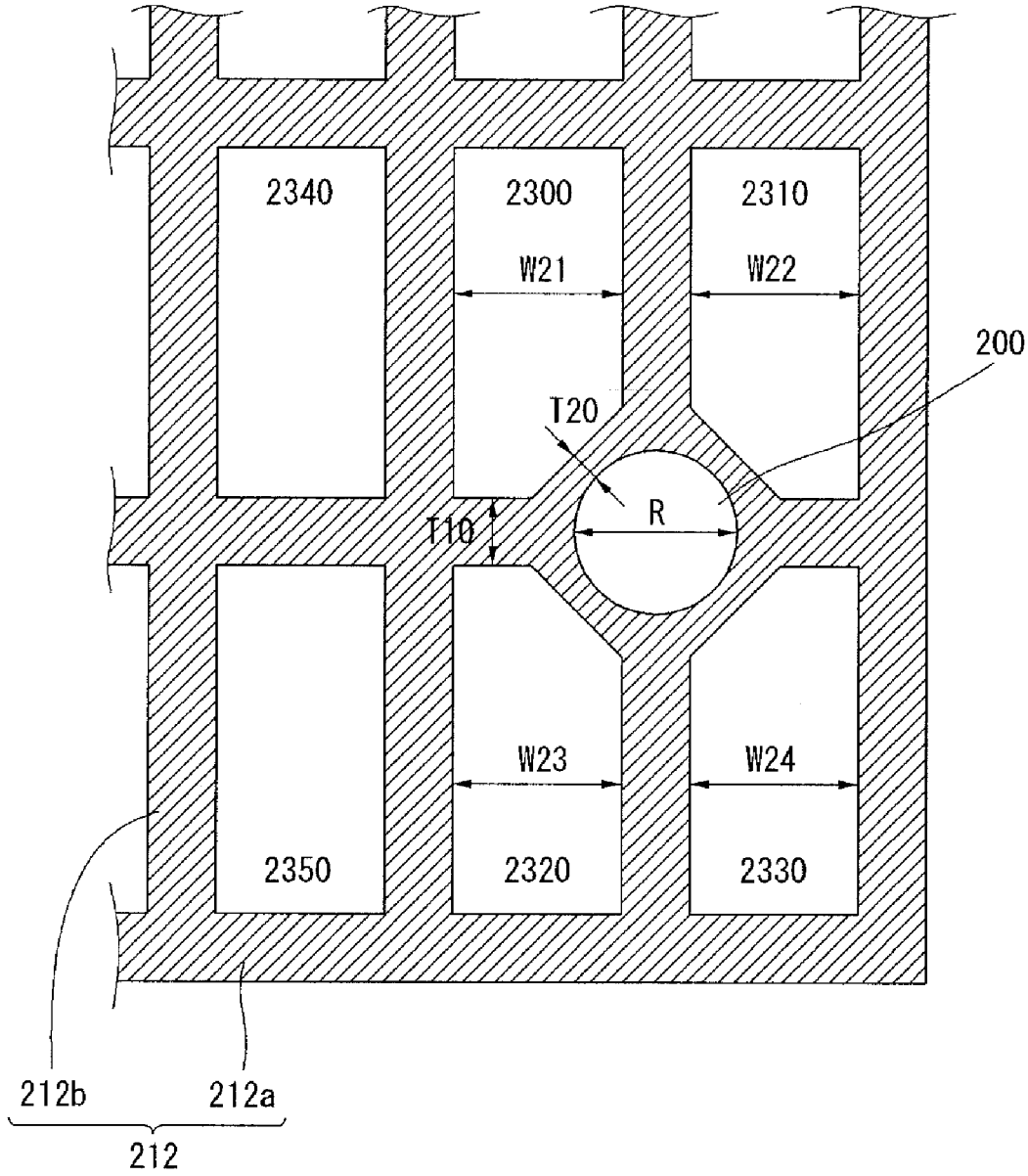

Alternatively, as shown in FIG. 23, when the barrier rib 212 includes a first barrier rib 212*a* parallel to the first electrode and a second barrier rib 212*b* crossing the first barrier rib 212*a*, the exhaust hole 200 may be formed in a crossing portion between the first barrier rib 212*a* and the second barrier rib 212*b*. As above, when the exhaust hole 200 is formed in a crossing portion between the first barrier rib 212*a* and the second barrier rib 212*b*, the exhaust hole 200 may be formed between at least two adjacent discharge cells.

A size of at least one of the plurality of discharge cells adjacent to the exhaust hole 200 may be smaller than a size of at least one of the plurality of discharge cells that are not adjacent to the exhaust hole 200, so as to provide a sufficient space for forming the exhaust hole 200 in a crossing portion between the first barrier rib 212*a* and the second barrier rib 212*b*.

For example, as shown in FIG. 23, when the exhaust hole 200 is formed in a crossing portion between the first barrier rib 212*a* and the second barrier rib 212*b* in a portion between first, second, third, and fourth discharge cells 2300, 2310, 2320, and 2330, sizes of the first, second, third, and fourth discharge cells 2300, 2310, 2320, and 2330 adjacent to the exhaust hole 200 may be smaller than fifth and sixth discharge cells 2340 and 2350 that are not adjacent to the exhaust hole 200.

Further, a shortest distance T20 between the exhaust hole 200 and the first discharge cell 2300 may be less than a width T10 of the first barrier rib 212*a* between the first and third discharge cells 2300 and 2320. In other words, the thickness T20 of the barrier rib 212 between the exhaust hole 200 and the first discharge cell 2300 may be less than the width T10 of the barrier rib 212 between the first and third discharge cells 2300 and 2320. In this case, a sufficient space for forming the exhaust hole 200 may be provided in the crossing portion between the first barrier rib 212*a* and the second barrier rib 212*b*.

It may be preferable that a diameter R of the exhaust hole 200 in a direction parallel to the first electrode (i.e., in a direction parallel to the first barrier rib 212*a*) is smaller than widths W21, W22, W23, W23 of the first, second, third, and fourth discharge cells 2300, 2310, 2320, and 2330, so as to prevent an excessive reduction in the sizes of the first, second, third, and fourth discharge cells 2300, 2310, 2320, and 2330 adjacent to the exhaust hole 200.

Figure 24:
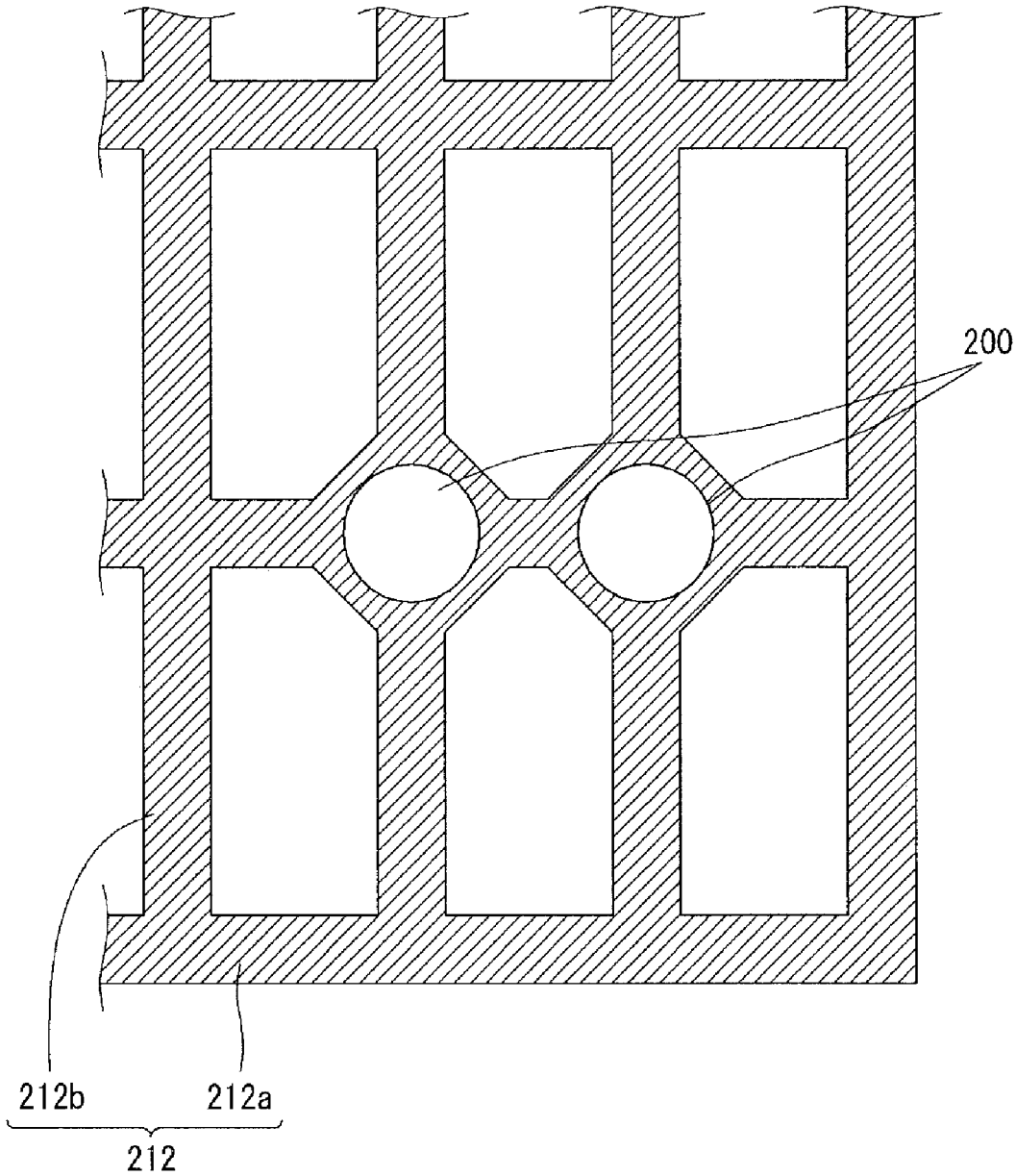

Alternatively, as shown in FIG. 24, a plurality of exhaust holes 200 may be formed. In this case, even when a diameter R of the exhaust hole 200 in a direction parallel to the first barrier rib 212*a* is smaller than widths W21, W22, W23, W23 of the first, second, third, and fourth discharge cells 2300, 2310, 2320, and 2330, the exhaust efficiency may be improved.

Figure 25:
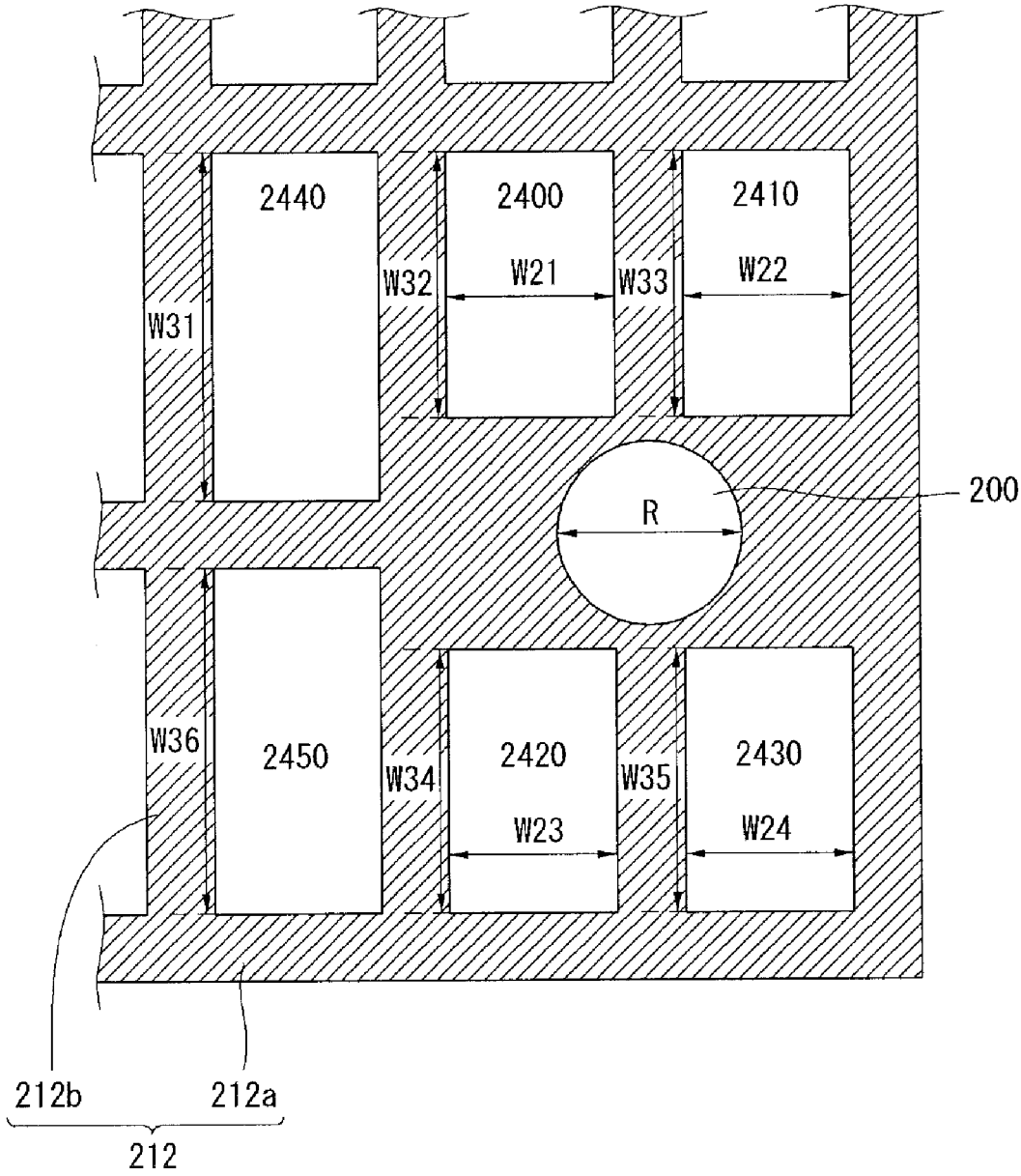

Further, as shown in FIG. 25, distance W32, W33, W34, and W35 between the first barrier ribs 212*a* in first, second, third, and fourth discharge cells 2400, 2410, 2420, and 2430 may be less than distances W31 and W36 between the first barrier ribs 212*a* in fifth and sixth discharge cells 2440 and 2450, so as to increase the size of the exhaust hole 200. In this case, sizes of the first, second, third, and fourth discharge cells 2400, 2410, 2420, and 2430 may be less than sizes of the fifth and sixth discharge cells 2440 and 2450.

Further, as shown in FIG. 25, a diameter R of the exhaust holes 200 in a direction parallel to the first barrier rib 212*a* may be greater than widths W21, W22, W23, and W24 of the first, second, third, and fourth discharge cells 2400, 2410, 2420, and 2430. Further, the second electrode may include a portion positioned around the exhaust holes 200 in a portion overlapping the barrier rib 212.

Figure 26:
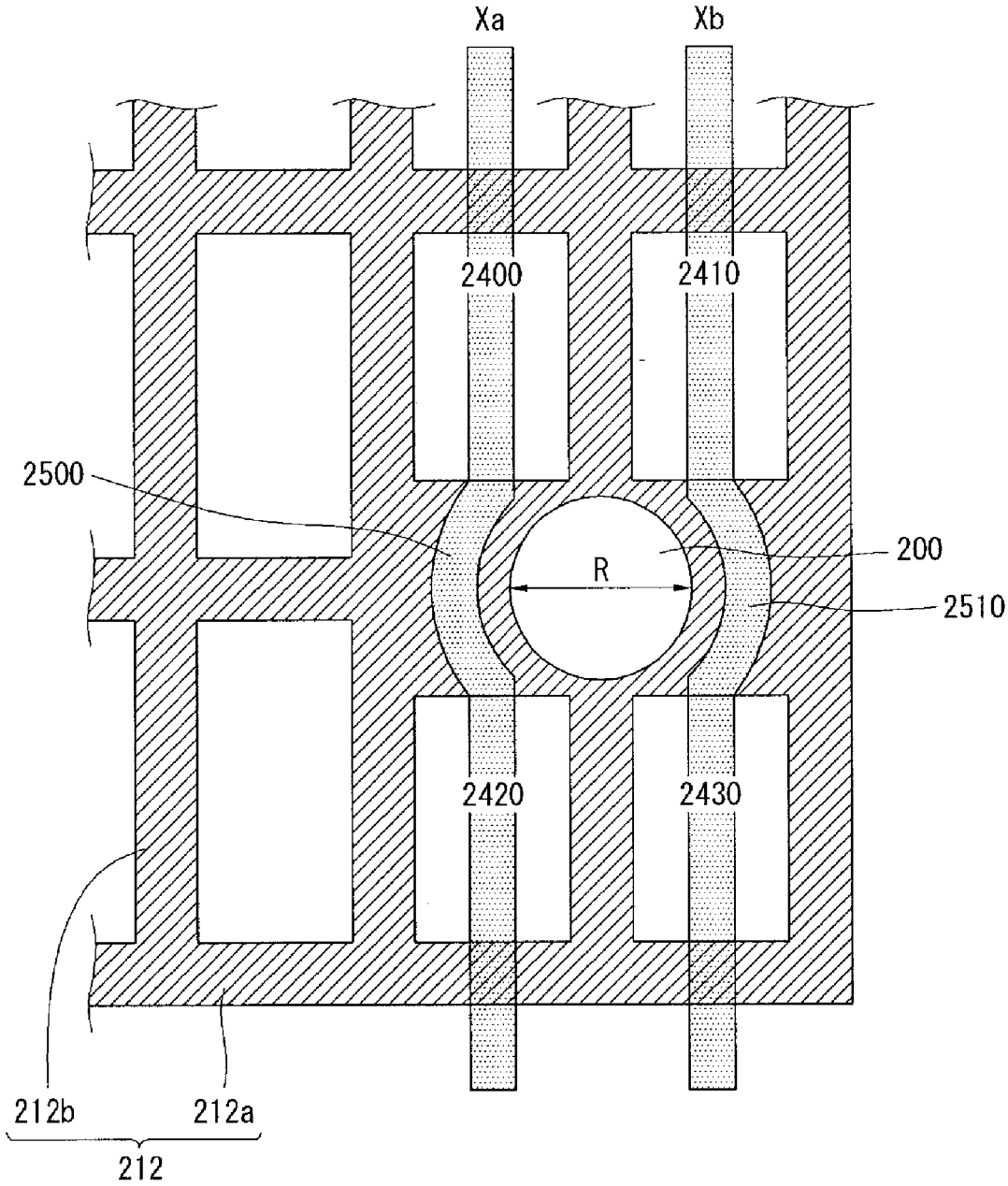

For example, as shown in FIG. 26, a second electrode Xa corresponding to first and third discharge cells 2400 and 2420 may include a convex curved portion 2500 in the opposite direction to the exhaust hole 200 in a portion overlapping a barrier rib (i.e., the first barrier rib 212*a*) between the first and third discharge cells 2400 and 2420. Further, a second electrode Xb corresponding to second and fourth discharge cells 2410 and 2430 may include a convex curved portion 2500 in the opposite direction to the exhaust hole 200 in a portion overlapping a barrier rib (i.e., the first barrier rib 212*a*) between the second and fourth discharge cells 2410 and 2430.

Figure 27:
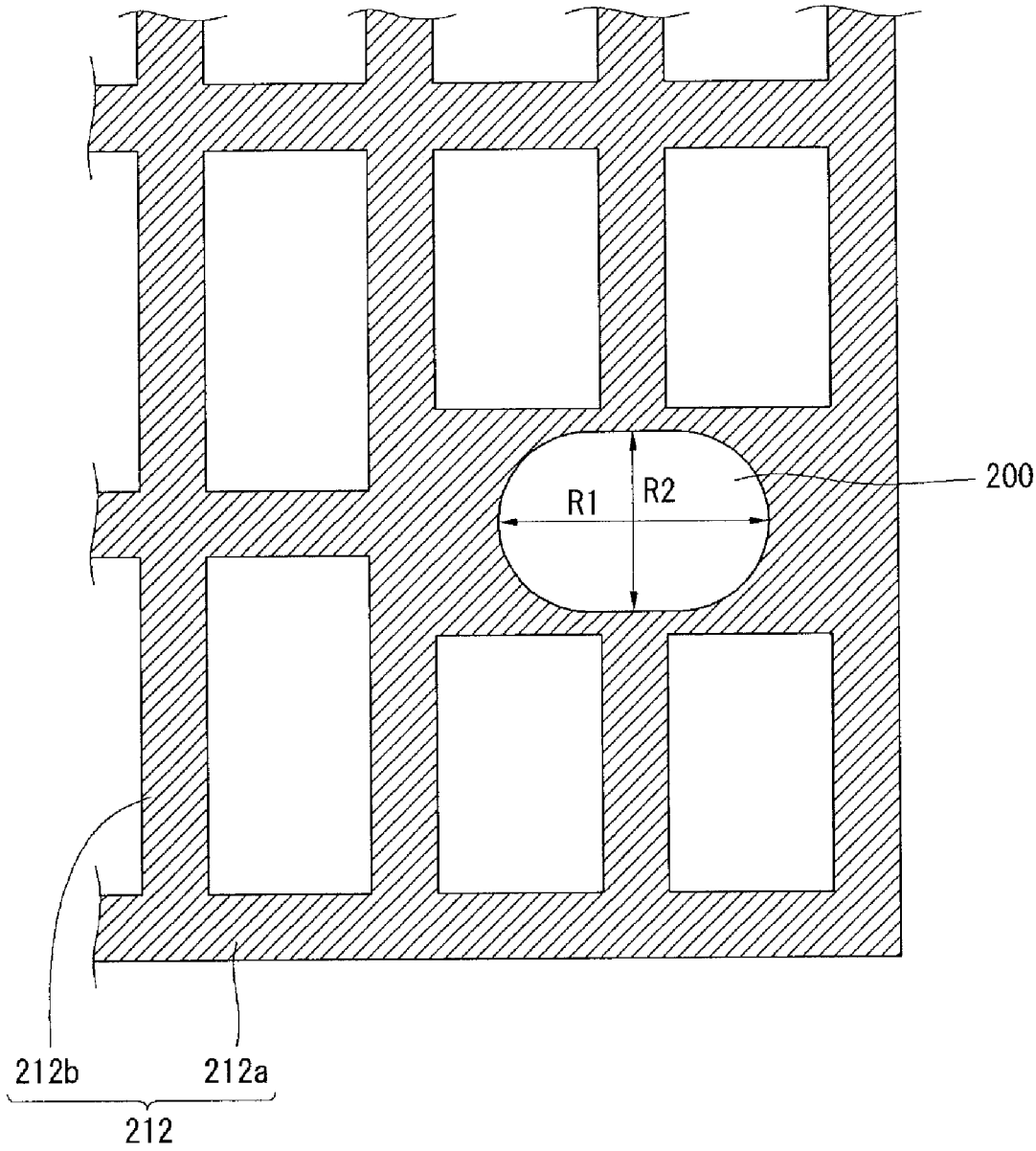

Further, as shown in FIG. 27, a diameter R1 of the exhaust hole 200 in a direction parallel to the first barrier rib 212*a* in an overlapping portion between the first and second barrier ribs 212*a* and 212*b* may be greater than a diameter R2 of the exhaust hole 200 in a direction parallel to the second barrier rib 212*b* in the overlapping portion. In this case, the size of the exhaust hole 200 may further increase, and the exhaust efficiency may be improved.

FIGS. 28 to 32 illustrate a multi plasma display panel according to an embodiment of the invention. All of characteristics of the plasma display panel illustrated in FIGS. 1 to 27 may be applied to the multi plasma display panel shown in FIGS. 28 to 32. Thus, structures and components identical or equivalent to those illustrated above are designated with the same reference numerals, and a further description may be briefly made or may be entirely omitted.

Figure 28:
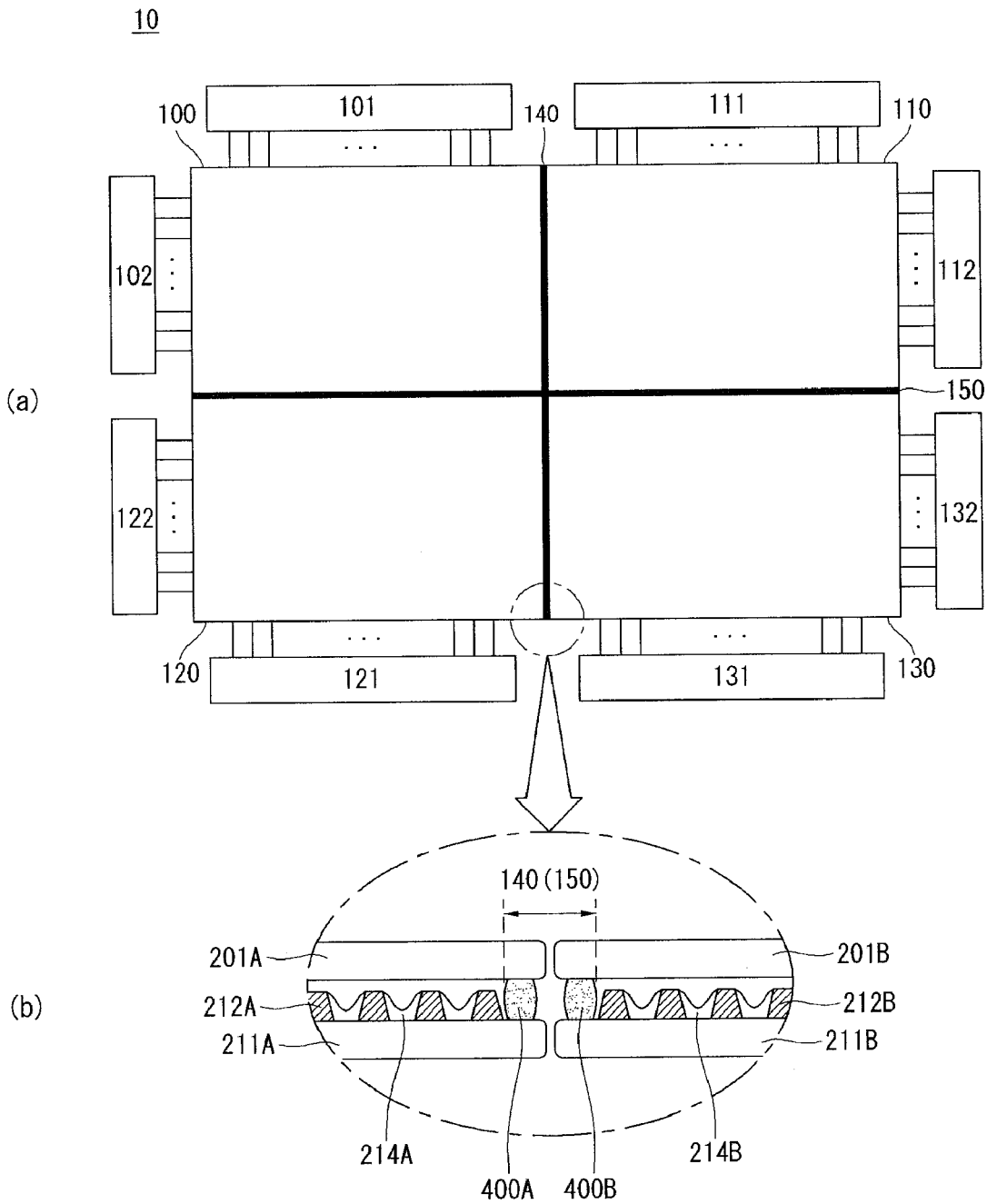
FIGS. 28 to 32 illustrate a multi plasma display panel according to an embodiment of the invention.

As shown in (a) of FIG. 28, a multi plasma display panel 10 according to an embodiment of the invention may include a plurality of plasma display panels 100, 110, 120, and 130 positioned adjacent to one another.

Among the plurality of plasma display panels 100, 110, 120, and 130, a 1-1 driver 101 and a 1-2 driver 102 may supply driving signals to the first plasma display panel 100. The 1-1 driver 101 and the 1-2 driver 102 may be integrated into one driver. Further, a 2-1 driver 111 and a 2-2 driver 112 supply driving signals to the second plasma display panel 110. In other words, the plasma display panels 100, 110, 120, and 130 may be structured so that a different driver supplies a driving signal to each of the plasma display panels 100, 110, 120, and 130.

Seam portions 140 and 150 are formed between two adjacent plasma display panels of the plurality of plasma display panels 100, 110, 120, and 130. The seam portions 140 and 150 may be called regions between the two adjacent plasma display panels.

In the multi plasma display panel 10, because an image is displayed on the plurality of plasma display panels 100, 110, 120, and 130 positioned adjacent to one another, the seam portions 140 and 150 may be formed between two adjacent plasma display panels.

The observer may perceive that the image displayed on the multi plasma display panel 10 seems to be discontinuous because of the first and second seam portions 140 and 150.

As described in detail with reference to FIGS. 1 to 27, when an exhaust hole 200 is formed in at least one of a plurality of discharge cells or is formed between at least two discharge cells, the size of the seam portions 140 and 150 may be reduced, and the natural image may be displayed.

A method of manufacturing the multi plasma display panel according to the embodiment of the invention is described below.

Figure 29:
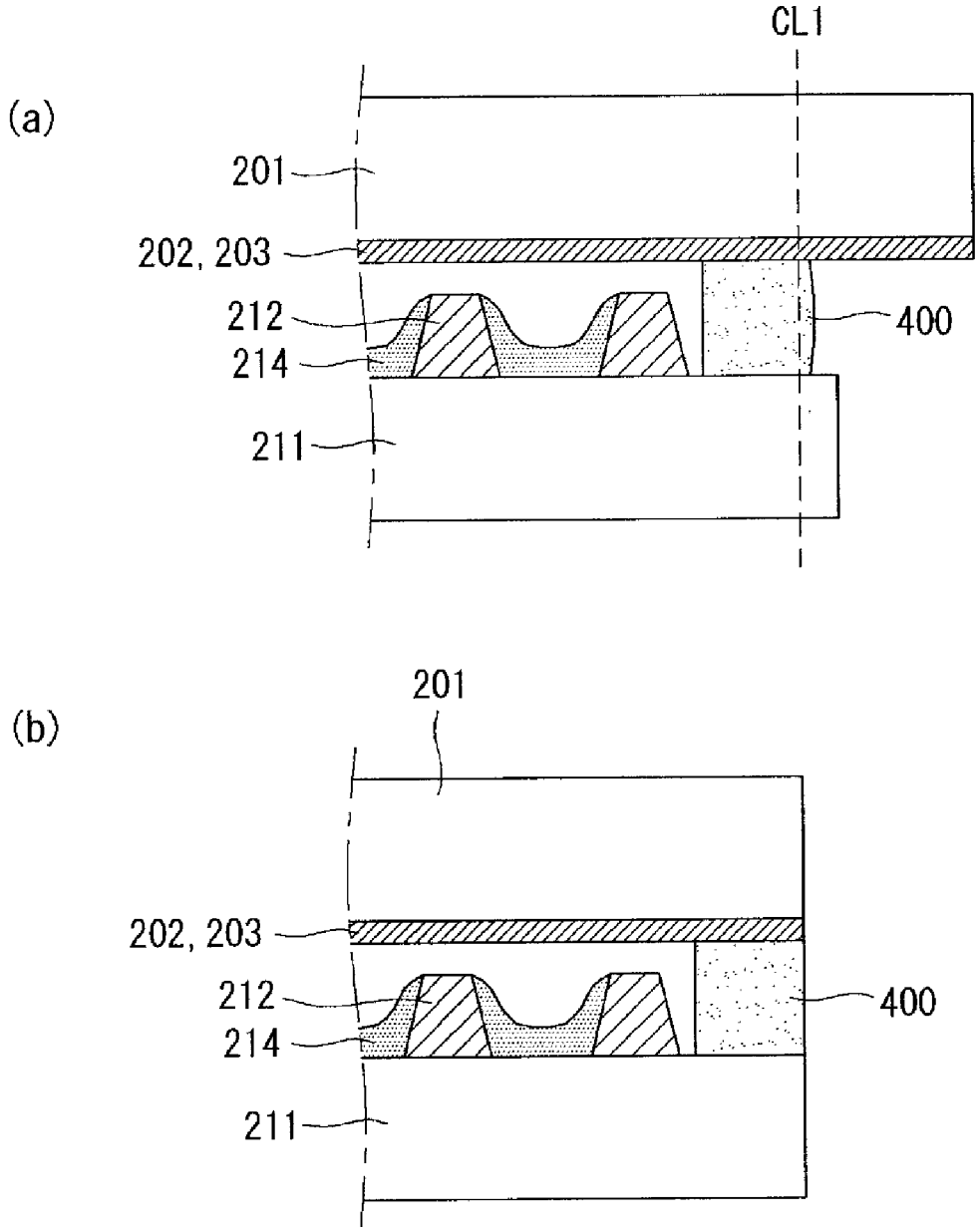

As shown in (a) of FIG. 29, a portion of each of a front substrate 201 and a rear substrate 211 may be cut along a predetermined cutting line CL1 in a state where the front substrate 201 and the rear substrate 211 are attached to each other. A grinding process may be performed during a cutting process.

As a result, as shown in (b) of FIG. 29, at least one of the front substrate 201 and the rear substrate 211 may be prevented from excessively protruding in a cutting portion. Further, the size of a portion on which an image is not displayed may be reduced.

In the cutting process for cutting the portion of each of the front substrate 201 and the rear substrate 211 shown in (a) of FIG. 29, the seal layer 400 may be cut. If the seal layer 400 is cut, the size of the portion on which the image is not displayed may be greatly reduced.

The plurality of plasma display panels manufactured using the method illustrated in FIG. 29 are positioned adjacent to one another to manufacture the multi plasma display panel.

In each of the plurality of plasma display panels of the multi plasma display panel 10, the exhaust hole 200 may be formed between at least two discharge cells adjacent to the seam portion.

Figure 30:
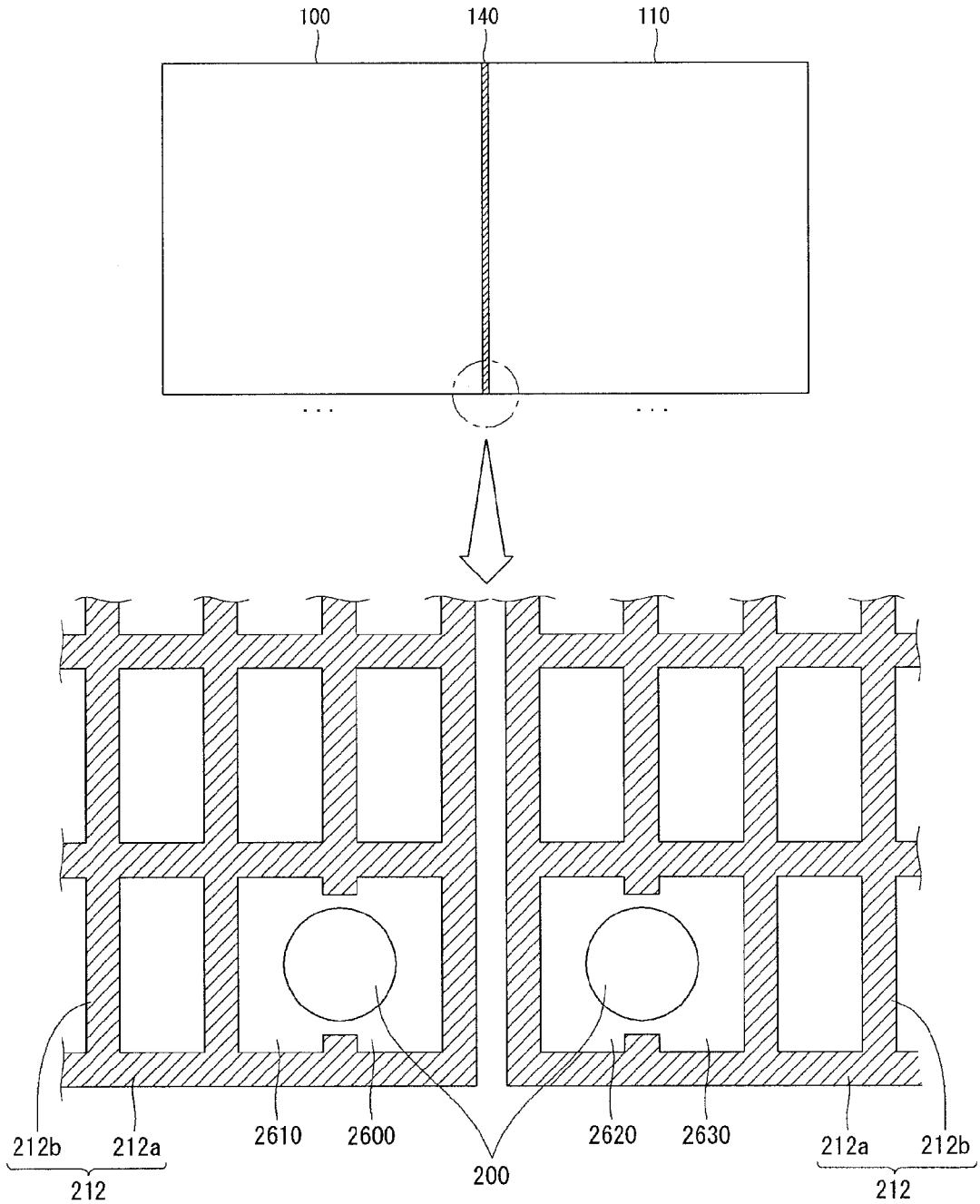

For example, as shown in FIG. 30, it is assumed that the multi plasma display panel 10 includes a first panel 100 and a second panel 110 adjacent to the first panel 100. In this case, the exhaust hole 200 in the first panel 100 may be formed in an overlapping portion between an outermost discharge cell 2600 adjacent to the second panel 110 among a plurality of discharge cells of the first panel 100 and a discharge cell 2610 adjacent to the outermost discharge cell 2600. Further, the exhaust hole 200 in the second panel 110 may be formed in an overlapping portion between an outermost discharge cell 2620 adjacent to the first panel 100 among a plurality of discharge cells of the second panel 110 and a discharge cell 2630 adjacent to the outermost discharge cell 2620.

As above, when the exhaust hole 200 is formed between at least two discharge cells adjacent to a seam portion 140 in each of the first and second panels 100 and 110, a possibility that an observer may perceive the discharge cells in which the exhaust hole 200 is formed may be reduced.

Figure 31:
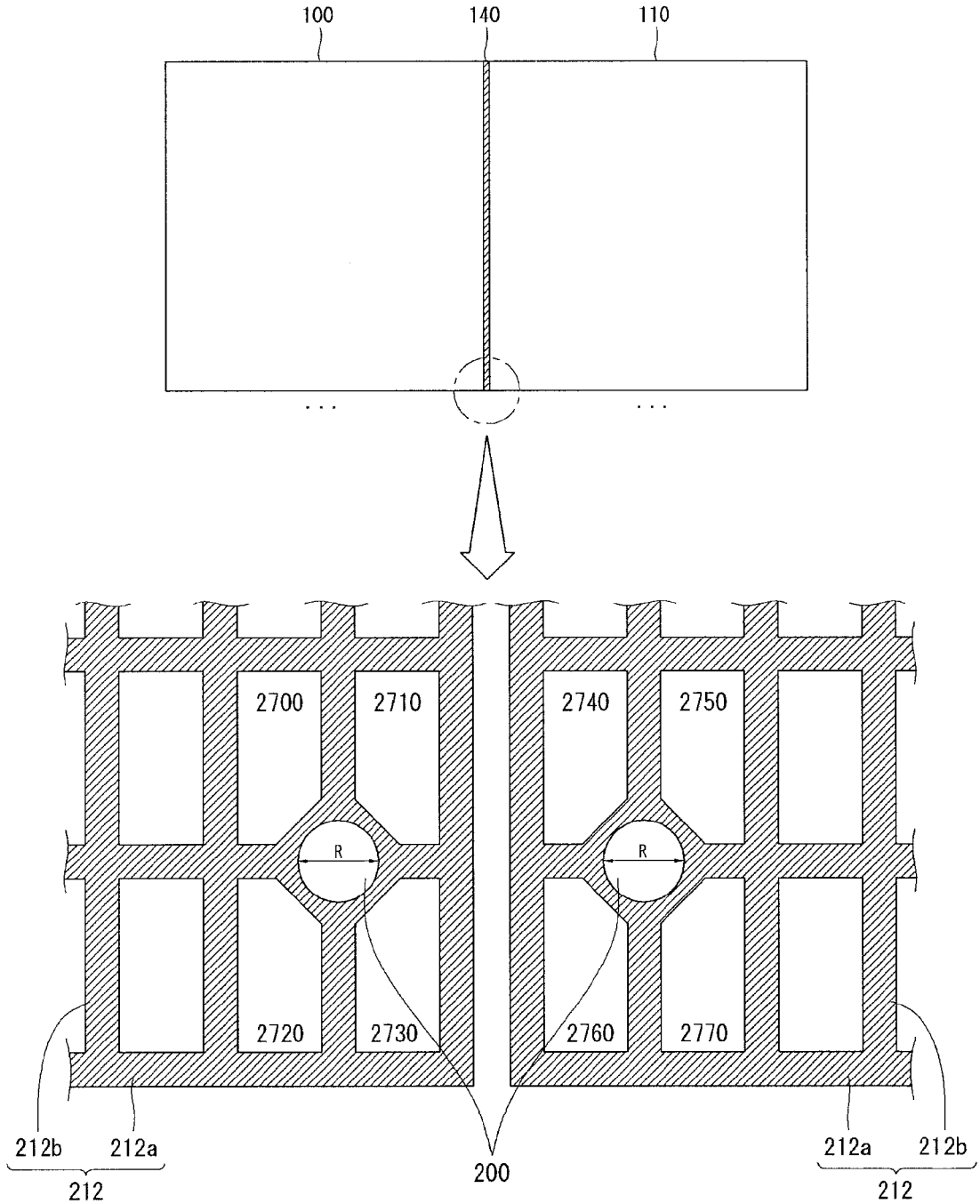

Alternatively, as shown in FIG. 31, while the exhaust hole 200 is formed in a crossing portion of a first barrier rib 212*a* and a second barrier rib 212*b* in the first panel 100, the exhaust hole 200 in the first panel 100 may be adjacent to the outermost discharge cell 2600 adjacent to the second panel 110 among the plurality of discharge cells of the first panel 100 and the discharge cell 2610 adjacent to the outermost discharge cell 2600. Further, while the exhaust hole 200 is formed in a crossing portion of a first barrier rib 212*a* and a second barrier rib 212*b* in the second panel 110, the exhaust hole 200 in the second panel 110 may be adjacent to the outermost discharge cell 2620 adjacent to the first panel 100 among the plurality of discharge cells of the second panel 110 and the discharge cell 2630 adjacent to the outermost discharge cell 2620.

Alternatively, in each plasma display panel of the multi plasma display panel 10, the exhaust hole 200 may be formed in the discharge cell adjacent to the seam portion.

Figure 32:
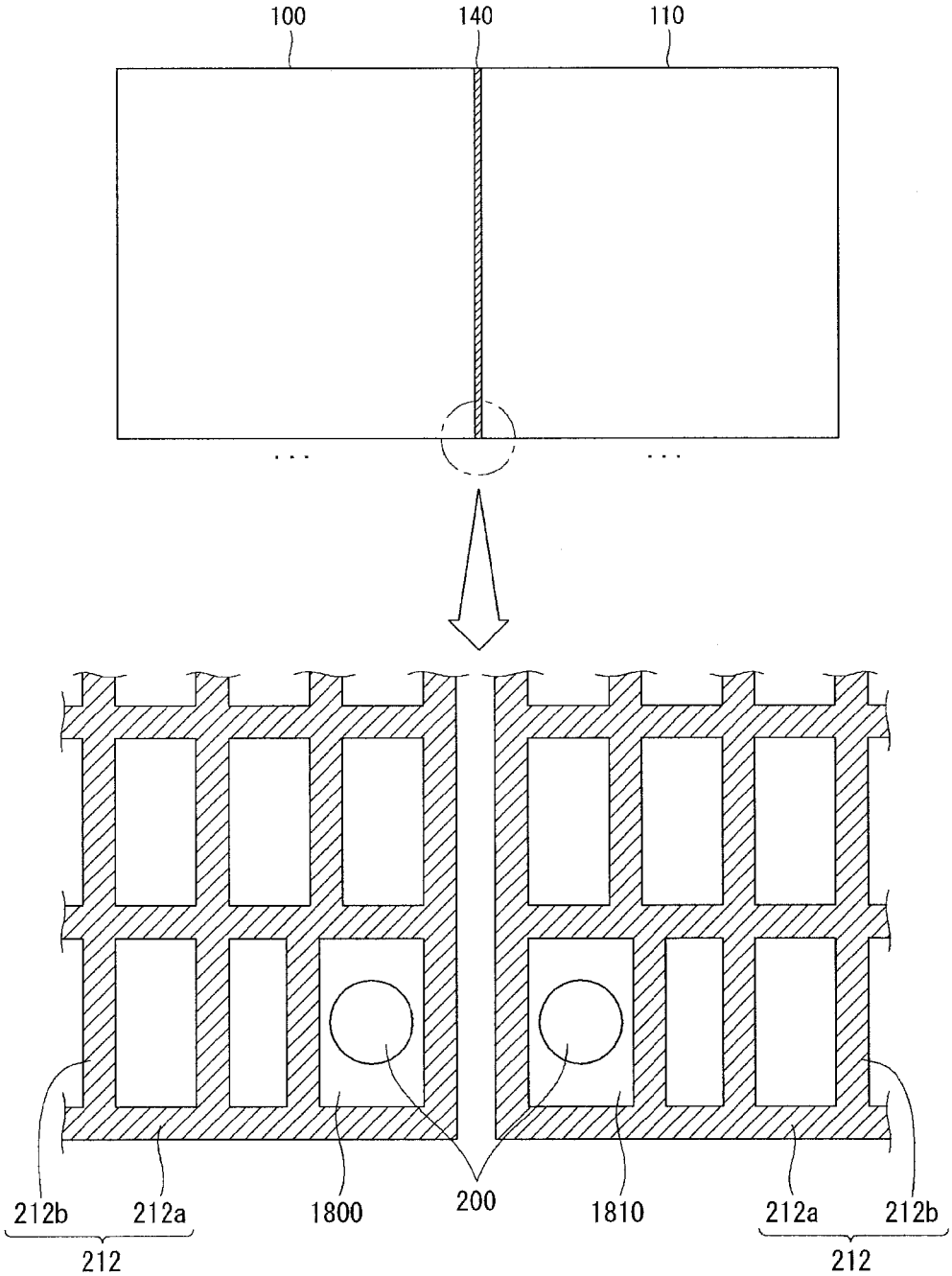

For example, as shown in FIG. 32, it is assumed that the multi plasma display panel 10 includes a first panel 100 and a second panel 110 adjacent to the first panel 100. In this case, the exhaust hole 200 in the first panel 100 may be formed in an outermost discharge cell 1800 adjacent to the second panel 110 among a plurality of discharge cells of the first panel 100 or a discharge cell adjacent to the outermost discharge cell 1800. Further, the exhaust hole 200 in the second panel 110 may be formed in an outermost discharge cell 1810 adjacent to the first panel 100 among a plurality of discharge cells of the second panel 110 or a discharge cell adjacent to the outermost discharge cell 1810.

As above, when the exhaust hole 200 is formed between the discharge cells 1800 and 1810 adjacent to a seam portion 140 in each of the first and second panels 100 and 110, a possibility that an observer may perceive the discharge cells in which the exhaust hole 200 is formed may be reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A multi plasma display panel comprising:

a plurality of plasma display panels positioned adjacent to one another, each of the plurality of plasma display panels including:

a front substrate on which a first electrode is positioned;

a rear substrate on which a second electrode crossing the first electrode is positioned;

a plurality of barrier ribs between the front substrate and the rear substrate, the plurality of barrier ribs at least substantially parallel to the first electrode and corresponding to a plurality of discharge cells; and an exhaust hole on the rear substrate, the exhaust hole being formed in at least one of the plurality of discharge cells, wherein a size of the at least one discharge cell in which the exhaust hole is formed is greater than a size of at least one discharge cell in which the exhaust hole is not formed, and wherein a distance between opposing barrier ribs corresponding to the at least one discharge cell in which the exhaust hole is formed in greater than a distance between opposing barrier ribs in the at least one discharge cell in which the exhaust hole is not formed.

2. The plasma display panel of claim 1, wherein the exhaust hole is formed in an outermost discharge cell of the plurality of discharge cells or a discharge cell adjacent to the outermost discharge cell.

3. The plasma display panel of claim 1, wherein a size of at least one of a plurality of discharge cells adjacent to the discharge cell in which the exhaust hole is formed is smaller than a size of at least one discharge cell that is not adjacent to the discharge cell in which the exhaust hole is formed.

4. The plasma display panel of claim 1, wherein a diameter of the exhaust hole in a direction crossing the barrier ribs is greater than a width of the discharge cell in which the exhaust hole is not formed in the direction crossing the barrier ribs.

5. The plasma display panel of claim 1, wherein the second electrode includes a portion formed around the exhaust hole.

6. The plasma display panel of claim 1, wherein the second electrode includes a convex portion in an opposite direction to the exhaust hole.

7. The plasma display panel of claim 1, wherein the plurality of barrier ribs are longitudinal barrier ribs.

8. The plasma display panel of claim 1, wherein the discharge cell in which the exhaust hole is located has a first size, the discharge cell in which the exhaust hole is not formed in a second side, and another discharge cell in which the exhaust hole is not formed is a third size.

9. The plasma display panel of claim 8, wherein the discharge cell in which the exhaust hole is not formed and said another discharge cell in which the exhaust hole is not formed are adjacent different sides of the discharge cell in which the exhaust hole is formed.

10. The plasma display panel of claim 1, wherein the discharge cell in which the exhaust hole is formed is located in an active area.

11. The plasma display panel of claim 1, wherein the discharge cell in which the exhaust hole is formed is located in an area outside an active area.

12. The plasma display panel of claim 1, wherein the discharge cell in which the exhaust hole is formed includes a barrier rib having a corner which protrudes into the discharge cell in which the exhaust hole is not formed.

13. A plasma display panel comprising:

a first substrate coupled to a first electrode;

a second substrate coupled to second electrode crossing the first electrode;

a plurality of barrier ribs between the first and second substrates and extending in substantially a same direction; and at least one exhaust hole through the first substrate or the second substrate at a position corresponding to a first discharge cell, wherein a size of the first discharge cell is different from a size of a second discharge cell which does not include an exhaust hole, wherein the size of the first discharge cell includes a first width corresponding to a separation distance between a first pair of adjacent barrier ribs, wherein a size of the second discharge cell includes a second width corresponding to a separation distance between a second pair of adjacent barrier ribs, and wherein the first width is different from the second width.

14. The plasma display panel of claim 13, wherein a width of the exhaust hole is substantially equal to or greater than the second width.

15. The plasma display panel of claim 13, wherein the first and second discharge cells are in an active area of the panel.

16. The plasma display panel of claim 13, wherein the first discharge cell is outside an active area of the panel and the second discharge cell is in the active area of the panel.

17. The plasma display panel of claim 13, wherein one of the first pair of adjacent barrier ribs corresponding to the first discharge cell is substantially linear and the other of the first pair of adjacent barrier ribs corresponding to the first discharge cell is curved.

18. The plasma display panel of claim 13, wherein one of the first or second electrodes includes a portion at least partially surrounding the exhaust hole.

* * * * *